US010522082B2

(12) United States Patent
Lee et al.

(10) Patent No.: US 10,522,082 B2
(45) Date of Patent: Dec. 31, 2019

(54) ORGANIC LIGHT EMITTING DISPLAY DEVICE AND METHOD FOR DRIVING THE SAME

(71) Applicant: LG DISPLAY CO., LTD., Seoul (KR)

(72) Inventors: YongKon Lee, Seoul (KR); Dong-Uk Lee, Goyang-si (KR)

(73) Assignee: LG Display Co., Ltd., Seoul (KR)

( * ) Notice: Subject to any disclaimer, the term of this patent is extended or adjusted under 35 U.S.C. 154(b) by 76 days.

(21) Appl. No.: 15/840,935

(22) Filed: Dec. 13, 2017

(65) Prior Publication Data

US 2018/0174517 A1 Jun. 21, 2018

(30) Foreign Application Priority Data

Dec. 21, 2016 (KR) ..... 10-2016-0175481

(51) Int. Cl.
*G09G 3/3233* (2016.01)
*G09G 3/3291* (2016.01)
*G09G 3/3266* (2016.01)

(52) U.S. Cl.
CPC ..... *G09G 3/3233* (2013.01); *G09G 3/3291* (2013.01); *G09G 3/3266* (2013.01); *G09G 2300/0426* (2013.01); *G09G 2300/0819* (2013.01); *G09G 2300/0842* (2013.01); *G09G 2310/08* (2013.01); *G09G 2320/0295* (2013.01); *G09G 2320/041* (2013.01); *G09G 2320/043* (2013.01); *G09G 2320/0693* (2013.01); *G09G 2330/028* (2013.01); *G09G 2330/12* (2013.01)

(58) Field of Classification Search
CPC ..... G09G 3/3233; G09G 3/3291; G09G 2300/0819; G09G 2330/028; G09G 2320/0295; G09G 2300/0842; G09G 2300/0426; G09G 2320/041; G09G 2310/08; G09G 2320/043; G09G 3/3266; G09G 2320/0693; G09G 2330/12
See application file for complete search history.

(56) References Cited

U.S. PATENT DOCUMENTS

2009/0315918 A1* 12/2009 Minami ..... G09G 3/3233 345/690
2015/0187278 A1* 7/2015 Park ..... G09G 3/3291 345/212

* cited by examiner

*Primary Examiner* — Mark W Regn
(74) *Attorney, Agent, or Firm* — Seed Intellectual Property Law Group LLP

(57) ABSTRACT

Disclosed is an OLED device which is capable of preventing a source voltage of a driving transistor so as to compensate for a deterioration of an organic light emitting diode from being out of a sensing voltage range of an analog-to-digital converter, and a method for driving the same, wherein a sensing timing is controlled in such a way that the source voltage of the driving transistor sensed for a sensing mode is included within the sensing voltage range. Accordingly, it is possible to prevent the source voltage of the driving transistor from being out of the sensing voltage range of the analog-to-digital converter.

18 Claims, 14 Drawing Sheets

ORGANIC LIGHT EMITTING DISPLAY DEVICE AND METHOD FOR DRIVING THE SAME

CROSS REFERENCE TO RELATED APPLICATIONS

This application claims the benefit of the Korean Patent Application No. 10-2016-0175481 filed on Dec. 21, 2016, which is hereby incorporated by reference as if fully set forth herein.

BACKGROUND

Technical Field

Embodiments of the present disclosure relate to an organic light emitting display device and a method for driving the same.

Description of the Related Art

With the advancement of an information-oriented society, various requirements for the display device of displaying an image are increasing. Thus, there are various display devices of liquid crystal display (LCD) devices, plasma display panel (PDP) devices, organic light emitting display (OLED) devices, etc. Among these display devices, the OLED device has been attracted as a next generation display device owing to advantages of a rapid response speed and a good low-grayscale expression in accordance with a self light emission type.

The OLED device may include a display panel having data lines, scan lines, and a plurality of sub-pixels provided every intersection of the data and scan lines, a scan driver for supplying scan signals to the scan lines, and a data driver for supplying data voltages to the data lines. Each of the sub-pixels may include an organic light emitting diode, a driving transistor for controlling an amount of current supplied to the organic light emitting diode in accordance with a voltage of a gate electrode, and a scan transistor for supplying the data voltage of the data line to the gate electrode of the driving transistor in response to the scan signal of the scan line.

A threshold voltage of the driving transistor may be changed by each pixel due to a deviation for a process of manufacturing the OLED device, and a deterioration of the driving transistor by a long-time operation. That is, if the same data voltage is applied to the pixels, the same current is supplied to the organic light emitting diodes. However, even though the same data voltage is applied to the pixels, the current supplied to the organic light emitting diode by each pixel may be changed due to the difference of the threshold voltage in the driving transistor of each pixel. Also, the organic light emitting diode may be deteriorated by a long-time operation. In this case, a luminance of the organic light emitting diode may be changed by each pixel. Accordingly, even though the same data voltage is applied to the pixels, the luminance by a light emission of the organic light emitting diode may be changed by each pixel. In order to overcome this problem, it has been proposed a method for compensating the threshold voltage and electron mobility of the driving transistor, and the deterioration of the organic light emitting diode.

The threshold voltage and electron mobility of the driving transistor, and the deterioration of the organic light emitting diode may be compensated in an external compensation method. In case of the external compensation method, a preset data voltage is supplied to each pixel, a source voltage of the driving transistor is sensed through a predetermined sensing line in accordance with the preset data voltage, the sensed voltage is converted into sensing data of digital data by the use of analog-to-digital converter, and digital video data to be supplied to the pixel in accordance with the sensing data is compensated.

Meanwhile, rise level and rise speed of the source voltage of the driving transistor may be changed by a temperature of a display panel. Especially, if the temperature of the display panel is high, the source voltage of the driving transistor is also raised. If identically maintaining a sensing timing point, the source voltage of the driving transistor for compensating the deterioration of the organic light emitting diode may be out of a sensing voltage range of the analog-to-digital converter. In this case, it is difficult to properly compensate for the deterioration of the organic light emitting diode.

BRIEF SUMMARY

Accordingly, embodiments of the present disclosure are directed to an organic light emitting display device that substantially obviates one or more problems due to limitations and disadvantages of the related art, and a method for driving the same.

An aspect of embodiments of the present disclosure is directed to provide an organic light emitting display device which is capable of preventing sensing data from being influenced by the change of the properties of an organic light emitting diode in accordance with a temperature. In detail, an aspect of embodiments of the present disclosure is directed to provide an organic light emitting display device which is capable of preventing a problem of precluding a proper supply of sensing data when it exceeds an ADC range for a sensing process at a predetermined temperature.

Additional advantages and features of embodiments of the disclosure will be set forth in part in the description which follows and in part will become apparent to those having ordinary skill in the art upon examination of the following or may be learned from practice of embodiments of the disclosure. The objectives and other advantages of embodiments of the disclosure may be realized and attained by the structure particularly pointed out in the written description and claims hereof as well as the appended drawings.

To achieve these and other advantages and in accordance with the purpose of embodiments of the disclosure, as embodied and broadly described herein, there is provided an OLED device that may include a display panel having a plurality of pixels, each of the pixels including an organic light emitting diode, wherein the pixels are connected with data lines, scan lines, and reference voltage lines, an analog-to-digital converter that senses voltages of the pixels through the reference voltage lines, and outputs sensing data as digital data, and a reference voltage generator that supplies a reference voltage to the reference voltage lines in a display mode during which the pixels emit light, wherein the analog-to-digital converter changes a sensing timing during which the analog-to-digital converter senses the voltages of the pixels based on a temperature of the display panel.

In another aspect of an embodiment of the present disclosure, there is provided a method for driving an OLED device including a display panel having a plurality of pixels, each of the pixels including an organic light emitting diode, wherein the pixels are connected with data lines, scan lines, and reference voltage lines, that may include: supplying a reference voltage to the reference voltage lines in a display mode during which each pixel emits light, sensing voltages of the pixels through the reference voltage lines within a sensing voltage range of the analog-to-digital converter, and outputting sensing data as digital data, and changing a sensing timing during which the voltages of the pixels are sensed based on a temperature of the display panel.

It is to be understood that both the foregoing general description and the following detailed description of embodiments of the present disclosure are exemplary and explanatory and are intended to provide further explanation of the disclosure as claimed.

BRIEF DESCRIPTION OF THE SEVERAL VIEWS OF THE DRAWINGS

The accompanying drawings, which are included to provide a further understanding of embodiments of the disclosure and are incorporated in and constitute a part of this application, illustrate embodiment(s) of the disclosure and together with the description serve to explain the principle of embodiments of the disclosure. In the drawings.

DETAILED DESCRIPTION

Figure 1:
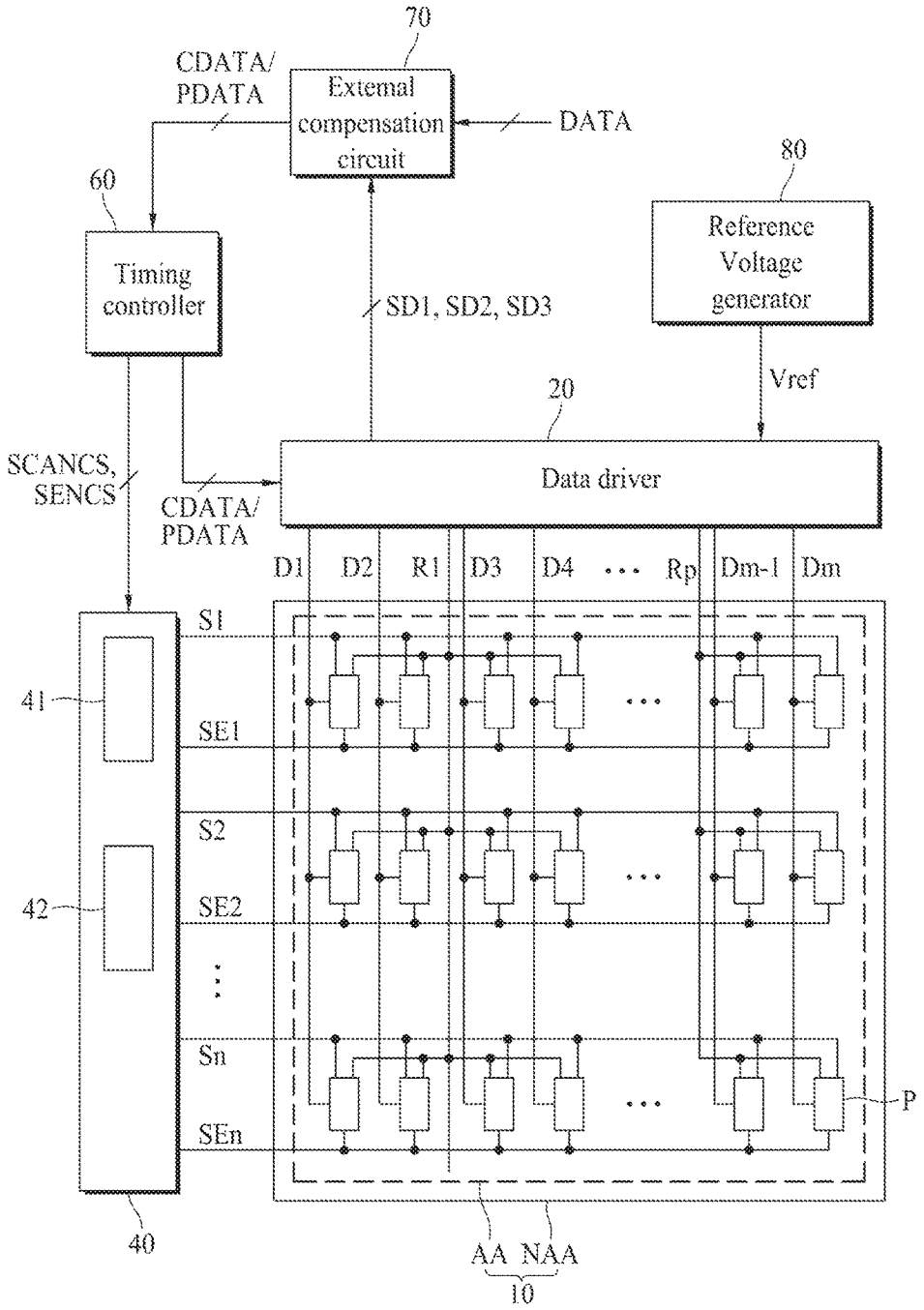
FIG. 1 is a block diagram illustrating an OLED device according to one or more embodiments of the present disclosure.

Reference will now be made in detail to the exemplary embodiments of the present disclosure, examples of which are illustrated in the accompanying drawings. Wherever possible or convenient for description of the embodiments provided herein, the same reference numbers will be used throughout the drawings to refer to the same or like parts. Advantages and features of the present disclosure, and implementation methods thereof will be clarified through the following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where "comprise", "have", and "include" described in the present specification are used, another part may be added unless "only" is used. The terms of a singular form may include plural forms unless referred to the contrary.

In construing an element, the element is construed as including an error region although there is no explicit description.

In describing a position relationship, for example, when the positional order of a first component is described as "on~", "above~", "below~", and "next~" to a second component, a case in which the first and second components are not in contact may be included unless exclusively limited by terms such as "just" or "direct".

In describing a time relationship, for example, when the temporal order is described as "after~", "subsequent~", "next~", and "before~", a case which is not continuous may be included unless terms such as "just" or "direct" are used.

It will be understood that, although the terms "first", "second", etc., may be used herein to describe various elements, these elements should not be limited by these terms. These terms are only used to distinguish one element from another. For example, a first element could be termed a second element, and, similarly, a second element could be termed a first element, without departing from the scope of the present disclosure.

Also, "X-axis direction", "Y-axis direction", and "Z-axis direction" are not limited to a perpendicular geometric configuration. That is, "X-axis direction", "Y-axis direction", and "Z-axis direction" may include an applicable wide range of a functional configuration.

Also, it should be understood that the term "at least one" includes all combinations related with any one item. For example, "at least one among a first element, a second element and a third element" may include all combinations of two or more elements selected from the first, second and third elements as well as any single element of the first, second and third elements. Also, if it is mentioned that a first element is positioned "on or above" a second element, it should be understood that the first and second elements may be brought into contact with each other, or a third element may be interposed between the first and second elements.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, an OLED device according to embodiments of the present disclosure and a method for driving the same will be described in detail with reference to the accompanying drawings.

Figure 2:
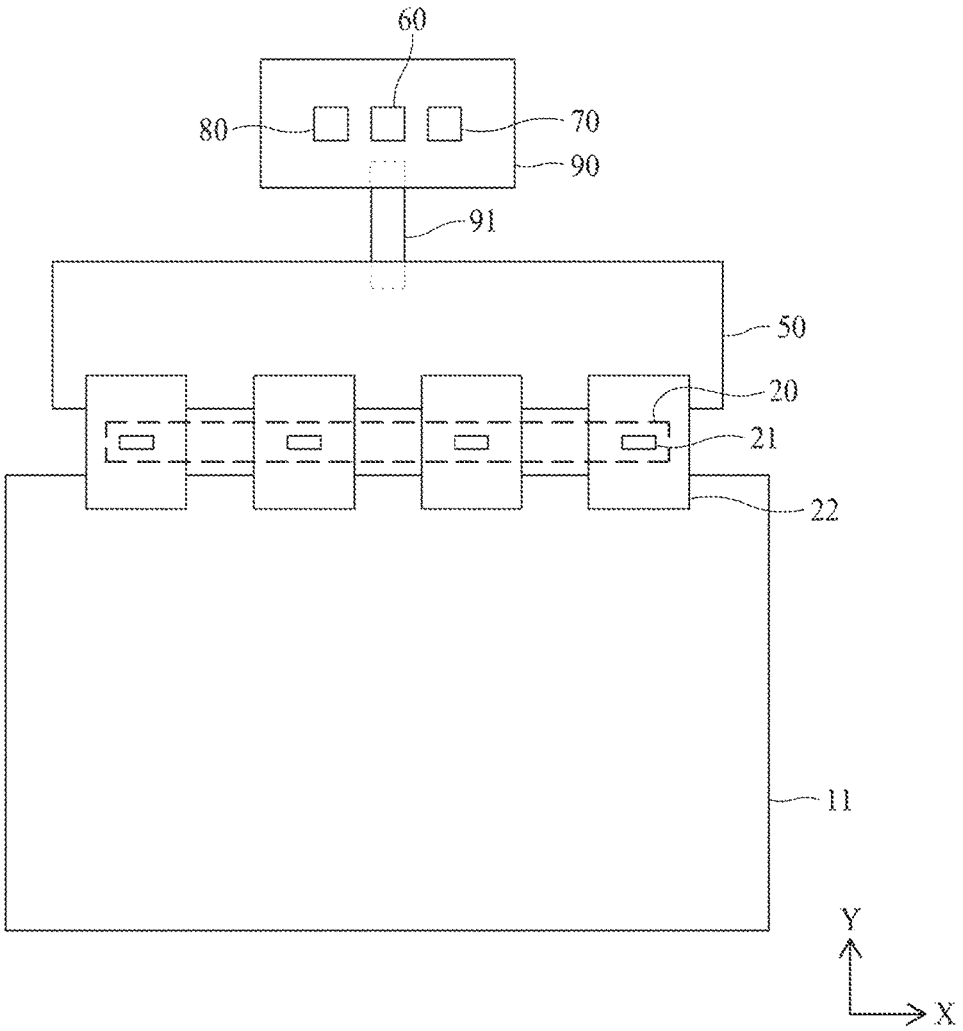
FIG. 2 illustrates a lower substrate, source drive ICs, a timing controller, an external compensation circuit, flexible films, a source printed circuit board, a flexible cable, and a control printed circuit board in a display panel of FIG. 1.
Figure 3:
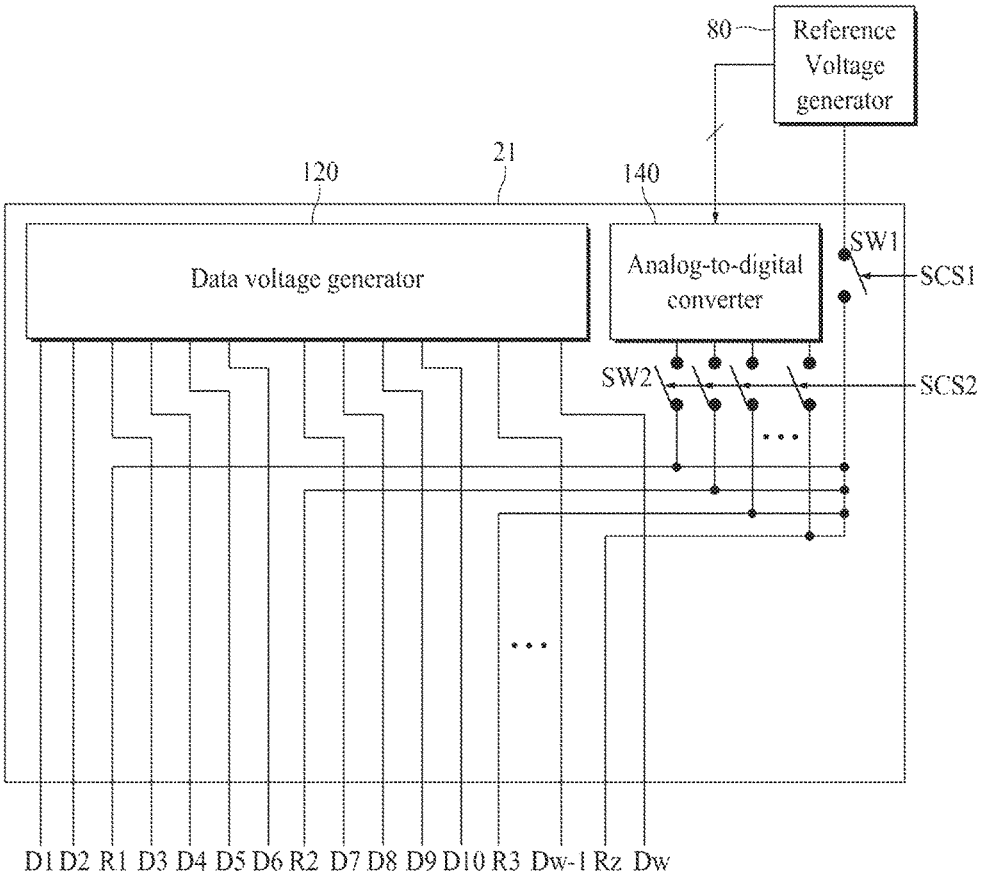
FIG. 3 is a block diagram illustrating a source drive IC of FIG. 2.

FIG. 1 is a block diagram illustrating an OLED device according to one embodiment of the present disclosure. FIG. 2 illustrates a lower substrate, source drive ICs, a timing controller, an external compensation circuit, flexible films, a source printed circuit board, a flexible cable, and a control printed circuit board in a display panel of FIG. 1. FIG. 3 is a detailed block diagram illustrating the source drive ICs of FIG. 2.

Referring to FIGS. 1 to 3, the OLED device according to one embodiment of the present disclosure may include a display panel 10, a data driver 20, flexible films 22, a scan driver 40, a source printed circuit board 50, a timing controller 60, an external compensation circuit 70, a reference voltage generator 80, a flexible cable 91, and a control printed circuit board 90.

The display panel 10 may include a display area (AA), and a non-display area (NAA) around the periphery of the display area (AA). The display area (AA) corresponds to an area where pixels (P) are disposed for displaying an image. The display panel 10 is provided with data lines (D1~Dm, 'm' is an integer of 2 or more than 2), reference voltage lines (R1~Rp, 'p' is an integer of 2 or more than 2), scan lines (S1~Sn, 'n' is an integer of 2 or more than 2), and sensing signal lines (SE1~SEn). The data lines (D1~Dm) and the reference voltage lines (R1~Rp) may intersect with the scan lines (S1~Sn) and the sensing signal lines (SE1~SEn). The data lines (D1~Dm) may be parallel to the reference voltage lines (R1~Rp). The scan lines (S1~Sn) may be parallel to the sensing signal lines (SE1~SEn).

Figure 4:
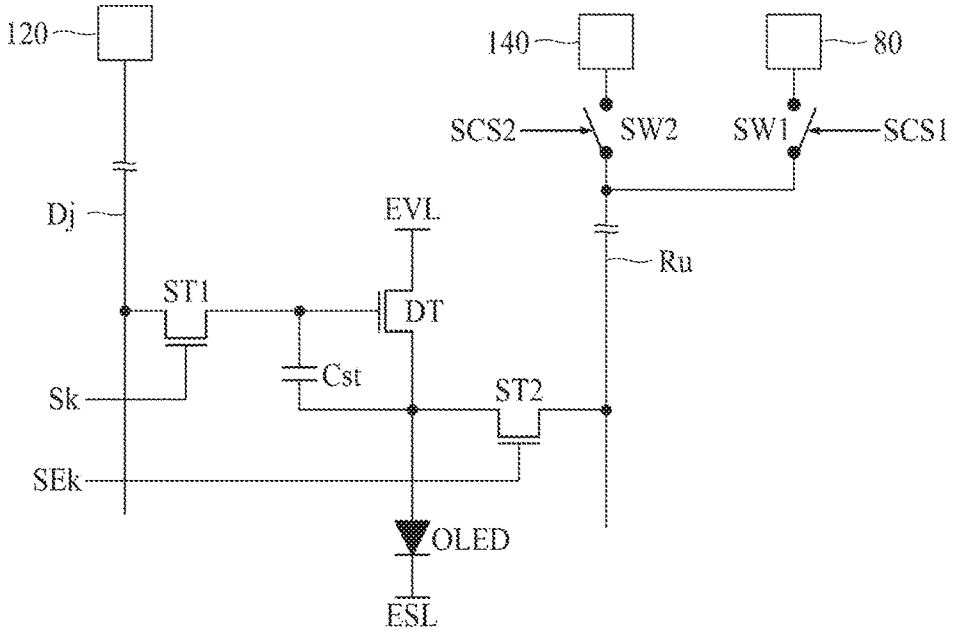
FIG. 4 is a detailed circuit diagram illustrating a pixel of FIG. 1.

Each of the pixels (P) may be connected with any one of the data lines (D1~Dm), any one of the reference voltage lines (R1~Rp), and any one of the scan lines (S1~Sn), and any one of the sensing signal lines (SE1~SEn). Each of the pixels (P) may include an organic light emitting diode (OLED), and a plurality of transistors for supplying a current to the organic light emitting diode (OLED), as shown in FIG. 4. Each of the pixels (P) in the display area (AA) will be described in detail with reference to FIG. 4.

The data driver 20 may include a plurality of source drive ICs 21, as shown in FIG. 2. Each of the source drive ICs 21 may be mounted on a respective one of the flexible films 22. Each of the flexible films 22 may be a tape carrier package or a chip on film, and each of the flexible films 22 may be bent or curved. Each of the flexible films 22 may be attached to the lower substrate 11 and the source printed circuit board 50. Each of the flexible films 22 may be attached to the lower substrate 11 by a tape automated bonding (TAB) method using an anisotropic conductive film, whereby the source drive ICs 21 may be connected with the data lines (D1~Dm). The source printed circuit board 50 may be connected with the control printed circuit board 90 by the use of flexible cable 91.

As shown in FIG. 3, each of the source drive ICs 21 may include a data voltage generator 120, an analog-to-digital converter 140, and one or more switches (SW). For convenience of explanation, FIG. 3 shows one source drive IC 21 which is connected with 'w' data lines (D1~Dw, herein, 'w' is an integer satisfying $1 \leq w \leq m$), and 'z' reference voltage lines (R1~Rz, herein, 'z' is an integer satisfying $1 \leq z \leq p$).

The data voltage generator 120 is connected with the data lines (D1~Dw), wherein the data voltage generator 120 supplies data voltages to the data lines (D1~Dw). The data voltage generator 120 receives compensation video data (CDATA), any one of first sensing video data to third sensing video data (PDATA1, PDATA2, PDATA3), and a data timing control signal (DCS).

The OLED device is operable in a display mode and in three different sensing modes, i.e., first through third sensing modes. In the display mode, the data voltage generator 120 converts the compensation video data (CDATA) into light-emission data voltages in accordance with the data timing control signal (DCS), and supplies the light-emission data voltages to the data lines (D1~Dw). The display mode corresponds to a mode for displaying an image through a light emission of the pixels (P). The light-emission data voltage corresponds to a voltage for making the organic light emitting diode (OLED) of the pixel (P) be driven to emit light with a predetermined luminance.

In the first sensing mode, the data voltage generator 120 converts the first sensing video data (PDATA1) into a first sensing data voltage in accordance with the data timing control signal (DCS), and supplies the first sensing data voltage to the data lines (D1~Dw). The first sensing mode corresponds to a threshold voltage compensating mode for sensing a source voltage of a driving transistor so as to compensate for a threshold voltage of the driving transistor in each pixel (P).

In the second sensing mode, the data voltage generator 120 converts the second sensing video data (PDATA2) into a second sensing data voltage in accordance with the data timing control signal (DCS), and supplies the second sensing data voltage to the data lines (D1~Dw). The second sensing mode corresponds to an electron mobility compensating mode for sensing a source voltage of the driving transistor so as to compensate for an electron mobility of the driving transistor in each pixel (P).

In the third sensing mode, the data voltage generator 120 converts the third sensing video data (PDATA3) into a third sensing data voltage in accordance with the data timing control signal (DCS), and supplies the third sensing data voltage to the data lines (D1~Dw). The third sensing mode corresponds to a deterioration compensating mode for sensing a source voltage of the driving transistor so as to compensate for a deterioration of the organic light emitting diode in each pixel (P).

The analog-to-digital converter 140 converts voltages sensed in the reference voltage lines (R1~Rz) in the first to third sensing modes into sensing data (SD) corresponding to digital data, and outputs the sensing data (SD) to the external compensation circuit 70.

A voltage range capable of being sensed by the analog-to-digital converter 140 is previously determined, and may be stored, for example, in a memory, such as a memory in the external compensation circuit 70 or any other memory accessible to the timing controller 60 and/or the analog-to-digital converter 140 such that the timing controller 60 and/or the analog-to-digital converter 140 can access the sensing voltage range and adjust a timing of the sensing operations as will be discussed in further detail below. However, a sensing range of the source voltage of the driving transistor may be changed in accordance with a temperature of the display panel 10. Especially, if the temperature rises, the source voltage of the driving transistor also rises. Thus, if the source voltage of the driving transistor rises, it may exceed the voltage range capable of being sensed by the analog-to-digital converter 140. In this case, it is possible to adjust a sensing timing so as to execute a sensing process within the voltage range capable of being sensed by the analog-to-digital converter 140.

In more detail, the analog-to-digital converter 140 advances the sensing timing for the sensing process, whereby the sensing process may be executed before a point in time when the source voltage of the driving transistor exceeds the voltage range capable of being sensed by the analog-to-digital converter 140. The sensing timing is previously set by the timing controller 60. The timing controller 60 senses the temperature of the display panel 10, and adjusts the sensing timing on the basis of the temperature of the display panel 10. If the temperature of the display panel 10 rises, the analog-to-digital converter 140 advances the sensing timing for the sensing process such that the sensing process is performed at a point in time before the source voltage of the driving transistor exceeds the voltage range capable of being sensed by the analog-to-digital converter 140. The timing controller 60 may sense the temperature of the display panel 10, for example, by a temperature sensor which may be internal to the timing controller 60, or may be disposed at any suitable location in or on the display panel 10 and communicatively coupled to the timing controller 60.

The sensing range of the source voltage of the driving transistor may be changed in each of the first to third sensing modes. Accordingly, the voltage range capable of being sensed by the analog-to-digital converter 140 may be differently set in each of the first to third sensing modes while being optimized for each of the first to third sensing modes.

The first switch (SW1) may be connected between the reference voltage lines (R1~Rz) and the reference voltage generator 80, to thereby switch the connection between the reference voltage lines (R1~Rz) and the reference voltage generator 80. The first switch (SW1) may be turned-on/off by a first switch control signal (SCS1) provided from the timing controller 60. If the first switch (SW1) is turned-on by the first switch control signal (SCS1), the reference voltage lines (R1~Rz) may be connected with the reference voltage generator 80 so that a reference voltage of the reference voltage generator 80 may be supplied to the reference voltage lines (R1~Rz).

The second switch (SW2) may be connected between the reference voltage lines (R1~Rz) and the analog-to-digital converter 140, to thereby switch the connection between the reference voltage lines (R1~Rz) and the analog-to-digital converter 140. The second switch (SW2) may be turned-on/off by a second switch control signal (SCS2) provided from the timing controller 60. If the second switch (SW2) is turned-on by the second switch control signal (SCS2), the reference voltage lines (R1~Rz) may be connected with the analog-to-digital converter 140 so that the source voltage of the driving transistor in each of the pixels (P) may be sensed through the reference voltage lines (R1~Rz).

The scan driver 40 includes a scan signal output unit 41, and a sensing signal output unit 42.

The scan signal output unit 41 is connected with the scan lines (S1~Sn), to thereby supply the scan signals. The scan signal output unit 41 supplies the scan signals to the scan lines (S1~Sn) in accordance with a scan timing control signal (SCANCS) provided from the timing controller 60.

The sensing signal output unit 42 is connected with the sensing signal lines (SE1~SEn), to thereby supply the sensing signals. The sensing signal output unit 42 supplies the sensing signals to the sensing signal lines (SE1~SEn) in accordance with a sensing timing control signal (SENCS) provided from the timing controller 60.

The scan signal output unit 41 and the sensing signal output unit 42, which include a plurality of transistors, may be directly formed in the non-display area (NAA) of the display panel 10 by a gate drier in panel (GIP) method. The scan signal output unit 41 and the sensing signal output unit 42 may be manufactured in a driving chip, and may be mounted on the flexible film (not shown) connected with the display panel 10.

The timing controller 60 receives the compensation video data (CDATA) or sensing video data (PDATA), and timing signals from the external compensation circuit 70. The timing signals may include a vertical synchronization signal, a horizontal synchronization signal, a data enable signal, and a dot clock.

The timing controller 60 generates timing control signals for controlling the operation timing of the data driver 20, the scan signal output unit 41, and the sensing signal output unit 42. The timing control signals may include the data timing control signal (DCS) for controlling the operation timing of the data driver 20, the scan timing control signal (SCS) for controlling the operation timing of the scan signal output unit 41, and the sensing timing control signal (SENCS) for controlling the operation timing of the sensing signal output unit 42.

The timing controller 60 outputs the compensation video data (CDATA) or sensing video data (PDATA), and the data timing control signal (DCS) to the data driver 20. The timing controller 60 outputs the scan timing control signal (SCANCS) to the scan signal output unit 41, and outputs the sensing timing control signal (SENCS) to the sensing signal output unit 42. Also, the timing controller 60 may output the switching control signals (SCS) for controlling the switches (SW) of the data driver 20.

Under the control of the timing controller 60, the OLED device may be driven in any one of the display mode, and the first to third sensing modes. In the display mode, the pixels (P) are supplied with the light-emission data voltages in accordance with the compensation video data (CDATA), whereby the pixels (P) emit light.

In the first sensing mode, the pixels (P) are supplied with the first sensing data voltages in accordance with the first sensing video data (PDATA1), and the voltages of the pixels (P) are sensed through the reference voltage lines (R1~Rp). The first sensing mode is used to sense the source voltage of the driving transistor so as to compensate for the threshold voltage of the driving transistor in each of the pixels (P). The source voltage of the driving transistor sensed in the first sensing mode may be converted into the first sensing data (SD1) by the analog-to-digital converter 140, and then the first sensing data (SD1) may be stored in a memory of the external compensation circuit 70. The first sensing mode may be executed before the OLED device is powered-off, but embodiments of the present disclosure are not limited to this type.

In the second sensing mode, the pixels (P) are supplied with the second sensing data voltages in accordance with the second sensing video data (PDATA2), and the voltages of the pixels (P) are sensed through the reference voltage lines (R1~Rp). The second sensing mode is used to sense the source voltage of the driving transistor so as to compensate for the electron mobility of the driving transistor in each of the pixels (P). The source voltage of the driving transistor sensed in the second sensing mode may be converted into the second sensing data (SD2) by the analog-to-digital converter 140, and then the second sensing data (SD1) may be stored in the memory of the external compensation circuit 70. The second sensing mode may be executed just after a power-on of the OLED device, or may be executed cyclically in a power-on state of the OLED device.

In the third sensing mode, the pixels (P) are supplied with the third sensing data voltages in accordance with the third sensing video data (PDATA3), and the voltages of the pixels (P) are sensed through the reference voltage lines (R1~Rp). The third sensing mode is used to sense the source voltage of the driving transistor in each of the pixels (P) so as to compensate for the deterioration of the organic light emitting diode in each of the pixels (P). The source voltage of the driving transistor sensed for the third sensing mode may be converted into the third sensing data (SD3) by the analog-to-digital converter 140, and then the third sensing data (SD3) may be stored in the memory of the external compensation circuit 70. The third sensing mode may be executed cyclically in a power-on state of the OLED device.

The first sensing video data to third sensing video data (PDATA1, PDATA2, PDATA3) may be the same or different from one another.

The external compensation circuit 70 generates correction data to correct the digital video data (DATA) by the use of first sensing data to third sensing data (SD1, SD2, SD3). The external compensation circuit 70 generates the compensation video data (CDATA) by applying the correction data to the digital video data (DATA). The external compensation circuit 70 outputs the compensation video data (CDATA) to the timing controller 60.

The external compensation circuit 70 may include the memory for storing the first sensing data to third sensing data (SD1, SD2, SD3). Additionally, the memory may store temperature data and/or sensing or voltage range data. For example, the memory may store data indicating voltage ranges capable of being sensed by the analog-to-digital convertor 140 at one or more temperatures. The memory of the external compensation circuit 70 may be a non-volatile memory such as an electrically erasable programmable read-only memory (EEPROM). The external compensation circuit 70 may be provided in the timing controller 60.

The reference voltage generator 80 generates the reference voltage, and supplies the generated reference voltage to the source drive ICs 21. The reference voltage generator 80 selects any one among first to third high voltages, and any one among first to third low voltages so as to set the sensing voltage range, and outputs the selected voltages to the analog-to-digital converter 140. The reference voltage generator 80 may generate driving voltages needed for driving the OLED device in addition to the reference voltage, and may supply the generated driving voltages to the corresponding elements.

The timing controller 60, the external compensation circuit 70, and the reference voltage generator 80 may be mounted on the control printed circuit board 90. The control printed circuit board 90 may be connected with the source printed circuit board 50 by the use of flexible cable 91.

As described above, the OLED device according to one or more embodiments of the present disclosure may convert the digital video data (DATA) into the compensation video data (CDATA) by the use of first sensing data to third sensing data (SD1, SD2, SD3) sensed in the sensing mode. As a result, it is possible to compensate for the threshold voltage of the driving transistor in each of the pixels (P), the electron mobility of the driving transistor in each of the pixels (P), and the deterioration of the organic light emitting diode in each of the pixels (P). The operation of the pixels (P) in the display mode will be described with reference to FIG. 5 and FIGS. 6A and 6B. The operation of the pixels (P) in the first sensing mode will be described with reference to FIG. 7, FIGS. 8A to 8C, and FIG. 9. The operation of the pixels (P) in the second sensing mode will be described with reference to FIG. 10, FIGS. 11A and 11B, and FIG. 12. The operation of the pixels (P) in the third sensing mode will be described with reference to FIG. 13, FIGS. 14A to 14D, and FIGS. 15 and 16.

FIG. 4 is a detailed circuit diagram illustrating the pixel (P) of FIG. 1.

For convenience of explanation, FIG. 4 shows only the jth data line (Dj, herein, 'j' is an integer satisfying $1 \leq j \leq m$), the uth reference voltage line (Ru, herein, 'u' is an integer satisfying $1 \leq u \leq p$), the kth scan line (Sk, herein, 'k' is an integer satisfying $1 \leq k \leq n$), the sub-pixel connected with the kth sensing signal line (SEk), the reference voltage generator 80, the data voltage generator 120, the analog-to-digital converter 140, the switch (SW1) connected between the uth reference voltage line (Ru) and the reference voltage generator 80, and the switch (SW2) connected between the uth reference voltage line (Ru) and the analog-to-digital converter 140.

Referring to FIG. 4, the pixel (P) of the display panel 10 includes the organic light emitting diode (OLED), the driving transistor (DT), first and second switching transistors (ST1, ST2), and a storage capacitor (Cst).

The organic light emitting diode (OLED) emits light in accordance with the current supplied through the driving transistor (DT). The organic light emitting diode (OLED) may include an anode electrode, a hole transporting layer, an organic light emitting layer, an electron transporting layer, and a cathode electrode. When a voltage is applied to the anode electrode and the cathode electrode of the organic light emitting diode (OLED), holes and electrons are transferred to the organic light emitting layer through the hole transporting layer and the electron transporting layer, whereby the organic light emitting diode (OLED) emits light by a bond of the hole and electron in the organic light emitting layer. The anode electrode of the organic light emitting diode (OLED) is connected with a source electrode of the driving transistor (DT), and the cathode electrode of the organic light emitting diode (OLED) is connected with a second power source line (ESL) supplied with a second power which is lower than a first power.

The driving transistor (DT) adjusts the current flowing from a first power source line (EVL) to the organic light emitting diode (OLED) in accordance with a voltage difference between the gate and source electrodes of the driving transistor (DT). The gate electrode of the driving transistor (DT) is connected with a first electrode of the first switching transistor (ST1), the source electrode of the driving transistor (DT) is connected with the anode electrode of the organic light emitting diode (OLED), and a drain electrode of the driving transistor (DT) is connected with the first power source line (EVL).

The first switching transistor (ST1) is turned-on by the kth scan signal of the kth scan line (Sk), whereby the jth data line (Dj) is connected with the gate electrode of the driving transistor (DT). A gate electrode of the first switching transistor (ST1) is connected with the kth scan line (Sk), a first electrode of the first switching transistor (ST1) is connected with a gate electrode of a first driving transistor (DT1), and a second electrode of the first switching transistor (ST1) is connected with the jth data line (Dj).

The second switching transistor (ST2) is turned-on by the kth sensing signal of the kth sensing signal line (SEk), whereby the uth reference voltage line (Ru) is connected with the source electrode of the driving transistor (DT). A gate electrode of the second switching transistor (ST2) is connected with the kth sensing signal line (SEk), a first electrode of the second switching transistor (ST2) is connected with the uth reference voltage line (Ru), and a second electrode of the second switching transistor (ST2) is connected with the source electrode of the driving transistor (DT).

The first electrode in each of the first and second switching transistors (ST1, ST2) corresponds to the source electrode, and the second electrode in each of the first and second switching transistors (ST1, ST2) corresponds to the drain electrode, but embodiments are not limited to this structure. That is, the first electrode in each of the first and second switching transistors (ST1, ST2) may be the drain electrode, and the second electrode in each of the first and second switching transistors (ST1, ST2) may be the source electrode.

The storage capacitor (Cst) is formed between the gate and source electrodes of the driving transistor (DT). The storage capacitor (Cst) stores a differential voltage between gate and source voltages of the driving transistor (DT).

The driving transistor (DT), and the first and second switching transistors (ST1, ST2) may be formed of thin film transistors. In FIG. 4, the driving transistor (DT), and the first and second switching transistors (ST1, ST2) are formed of N-type metal oxide semiconductor field effect transistors (N-type MOSFET), but embodiments are not limited to this type. For example, the driving transistor (DT), and the first and second switching transistors (ST1, ST2) may be formed of P-type metal oxide semiconductor field effect transistors (N-type MOSFET). In this case, FIGS. 5, 7, 10 and 13 may be correspondingly changed based on the properties of the P-type MOSFET.

Figure 5:
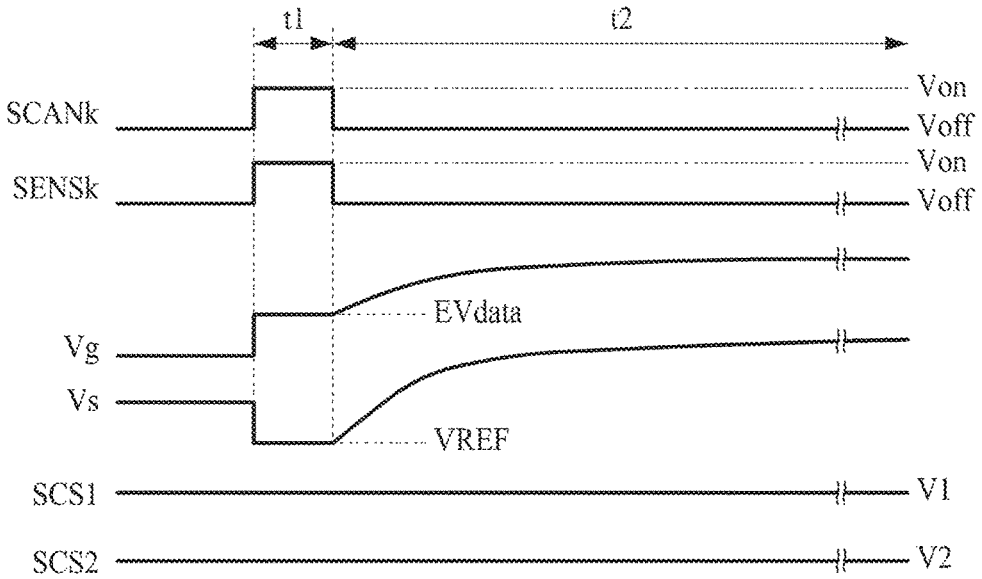
FIG. 5 is a waveform diagram illustrating scan and sensing signals supplied to a pixel, first and second switch control signals supplied to first and second switches, and gate and source voltages of a driving transistor for a display mode.

FIG. 5 is a waveform diagram illustrating the scan and sensing signals supplied to the pixel, the switch control signals supplied to the switches, and the gate and source voltages of the driving transistor for the display mode.

For the display mode, referring to FIG. 5, one frame period (1 frame period) may include a first period (t1) and a second period (t2). For the first period (t1), the light-emission data voltage (EVdata) is supplied to the gate electrode of the driving transistor (DT), and the source electrode is initialized with the reference voltage (VREF). For the second period (t2), the organic light emitting diode (OLED) emits light in accordance with the current (Ids) of the driving transistor (DT). The first period (t1) may be one horizontal period (1 horizontal period), wherein one horizontal period indicates a period for supplying the data voltages to the pixels (P) of one horizontal line.

The kth scan signal (SCANk) of the kth scan line (Sk) and the kth sensing signal (SENSk) of the kth sensing signal line (SEk) are supplied as a gate-on voltage (Von) for the first period (t1), and are supplied as a gate-off voltage (Voff) for the second period (t2). The first and second switching transistors (ST1, ST2) of the pixel (P) may be turned-on by the gate-on voltage (Von), and may be turned-off by the gate-off voltage (Voff).

The first switch control signal (SCS1) may be supplied as a first logic level voltage (V1) for the first and second periods (t1, t2). The second switch control signal (SCS2) may be supplied as a second logic level voltage (V2) for the first and second periods (t1, t2). The first and second switches (SW1, SW2) may be turned-on by the first logic level voltage, and may be turned-off by the second logic level voltage.

Figure 6A:
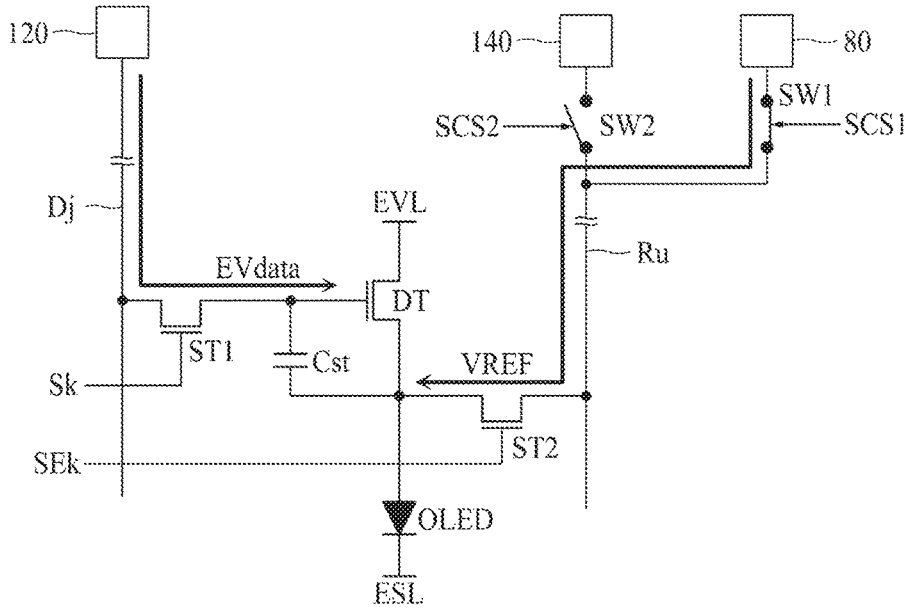
FIGS. 6A and 6B illustrate an operation of the pixel in the display mode for first and second periods.
Figure 6B:
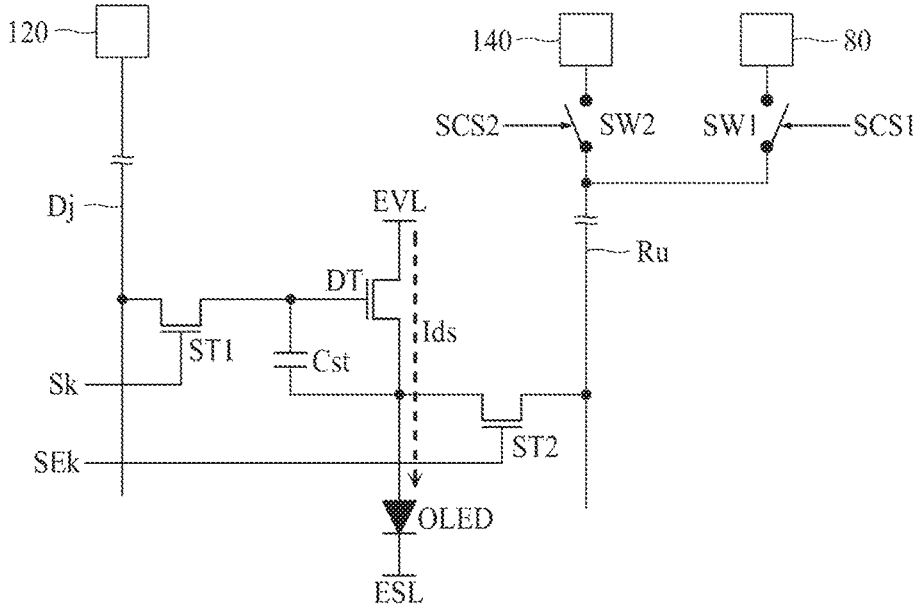

FIGS. 6A and 6B illustrate the operation of the pixel (P) for the first and second periods of the display mode. Hereinafter, the operation of the pixel (P) in the display mode will be described in detail with reference to FIG. 5 and FIGS. 6A and 6B.

For the first and second periods (t1, t2) of the display mode, the first switch (SW1) is turned-on by the first switch control signal (SCS1) of the first logic level voltage (V1), and the second switch (SW2) is turned-off by the second switch control signal (SCS2) of the second logic level voltage (V2). In the display mode, the reference voltage (VREF) is supplied from the reference voltage generator 80 to the uth reference voltage line (Ru) through the first switch (SW1).

Firstly, as shown in FIG. 6A, the first switching transistor (ST1) is turned-on by the kth scan signal (SCANk) of the gate-on voltage (Von) supplied to the kth scan line (Sk) for the first period (t1), and the second switching transistor (ST2) is turned-on by the kth sensing signal (SENSk) of the gate-on voltage (Von) supplied to the kth sensing signal line (SEk) for the first period (t1). For the first period (t1), the first switching transistor (ST1) is turned-on so that the light-emission data voltage (EVdata) of the jth data line (Dj) is supplied to the gate electrode of the driving transistor (DT). For the first period (t1), the second switching transistor (ST2) is turned-on so that the reference voltage (VREF) of the uth reference voltage line (Ru) is supplied to the source electrode of the driving transistor (DT).

Secondly, as shown in FIG. 6B, the first switching transistor (ST1) is turned-off by the kth scan signal (SCANk) of the gate-off voltage (Voff) supplied to the kth scan line (Sk) for the second period (t2), and the second switching transistor (ST2) is turned-off by the kth sensing signal (SENSk) of the gate-off voltage (Voff) supplied to the kth sensing signal line (SEk) for the second period (t2).

For the second period (t2), the current (Ids) in accordance with the voltage difference between the gate voltage (Vg) and the source voltage (Vs) of the driving transistor (DT) flows through the organic light emitting diode (OLED). Hereinafter, for convenience of explanation, the current (Ids) flowing through the driving transistor (DT) in accordance with the voltage difference between the gate voltage (Vg) and the source voltage (Vs) of the driving transistor (DT) is defined as the current (Ids) of the driving transistor.

As described above, the light-emission data voltage (EVdata) is supplied to the pixel (P) in the display mode according to one embodiment of the present disclosure. The light-emission data voltage (EVdata) is the data voltage generated in accordance with the compensation video data (CDATA) obtained by compensating the digital video data (DATA) after sensing the source voltage of the driving transistor (DT) in the sensing mode. As a result, the organic light emitting diode (OLED) of the pixel (P) may emit light in accordance with the current (Ids) of the driving transistor (DT) without dependence on the threshold voltage of the driving transistor (DT), to thereby improve uniformity of luminance in the pixels (P).

Figure 7:
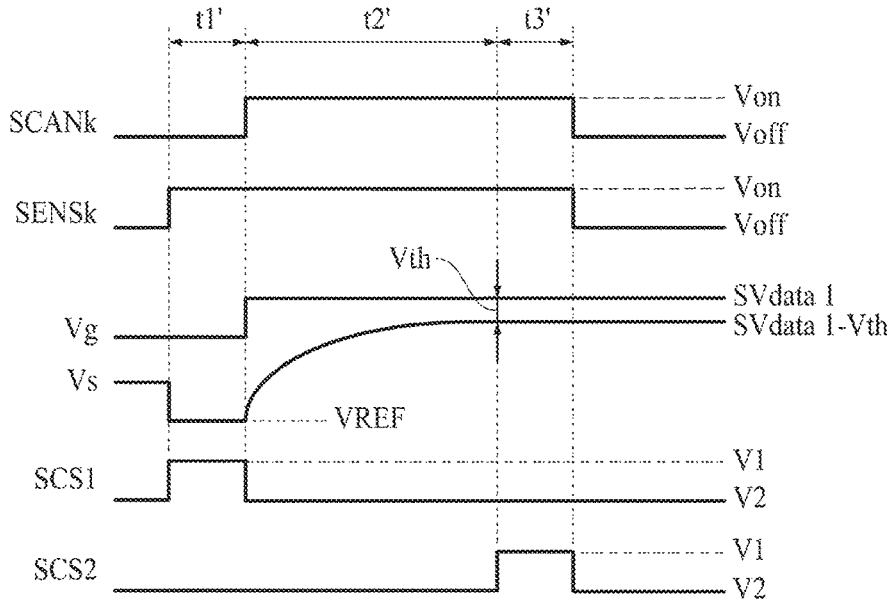
FIG. 7 is a waveform diagram illustrating scan and sensing signals supplied to the pixel, first and second switch control signals supplied to the first and second switches, and gate and source voltages of the driving transistor for a first sensing mode.

FIG. 7 is a waveform diagram illustrating the scan and sensing signals supplied to the pixel, the first and second switch control signals supplied to the first and second switches, and the gate and source voltages of the driving transistor for the first sensing mode.

For the first sensing mode, referring to FIG. 7, one frame period (1 frame period) may include first to third periods (t1'~t3'). For the first period (t1'), the source electrode of the driving transistor (DT) is initialized with the reference voltage (VREF). For the second period (t2'), the first sensing data voltage (SVdata1) is supplied to the gate electrode of the driving transistor (DT). For the third period (t3'), the source voltage of the driving transistor (DT) is sensed.

The kth scan signal (SCANk) of the kth scan line (Sk) is supplied as a gate-on voltage (Von) for the second and third periods (t2', t3'). In FIG. 7, the kth scan signal (SCANk) of the kth scan line (Sk) is supplied as the gate-off voltage (Voff) for the first period (t1'). However, the kth scan signal (SCANk) of the kth scan line (Sk) may be supplied as the gate-on voltage (Von) for the first period (t1'). The kth sensing signal (SENSk) of the kth sensing signal line (SEk) is supplied as the gate-on voltage (Von) for the first to third periods (t1'~t3'). The first and second switching transistors (ST1, ST2) of the pixel (P) may be turned-on by the gate-on voltage (Von), and may be turned-off by the gate-off voltage (Voff).

The first switch control signal (SCS1) may be supplied as a first logic level voltage (V1) for the first period (t1'), and may be supplied as a second logic level voltage (V2) for the second and third periods (t2', t3'). The second switch control signal (SCS2) may be supplied as the second logic level voltage (V2) for the first and second periods (t1', t2'), and may be supplied as the first logic level voltage (V1) for the third period (t3'). The first and second switches (SW1, SW2) may be turned-on by the first logic level voltage, and may be turned-off by the second logic level voltage.

For the sensing process, a process of measuring a temperature of the display panel 10 and a process of controlling sensing timing corresponding to the measured temperature are carried out at the same time. For the sensing process, a principle for controlling the sensing timing may be applied to the aforementioned process for sensing the threshold voltage, but embodiments are not limited to this type. The principle for controlling the sensing timing for the sensing process may be applied to processes for sensing the electron mobility and sensing the OLED deterioration. Accordingly, it is possible to prevent a sensing error caused by the temperature rise of the display panel 10 from occurring in all sensing processes applied to the OLED device.

Figure 8A:
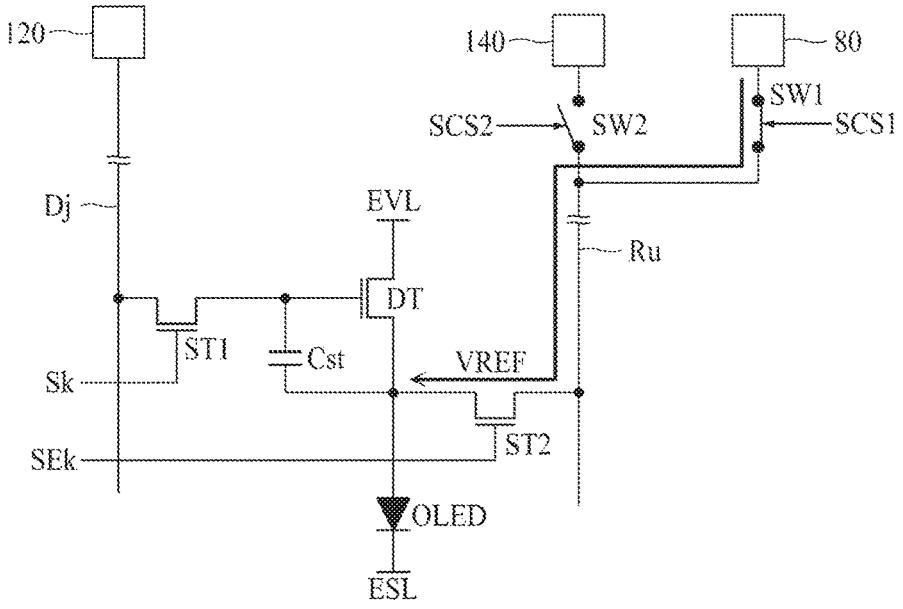
FIGS. 8A to 8C illustrate an operation of the pixel in the first sensing mode for first to third periods.
Figure 8B:
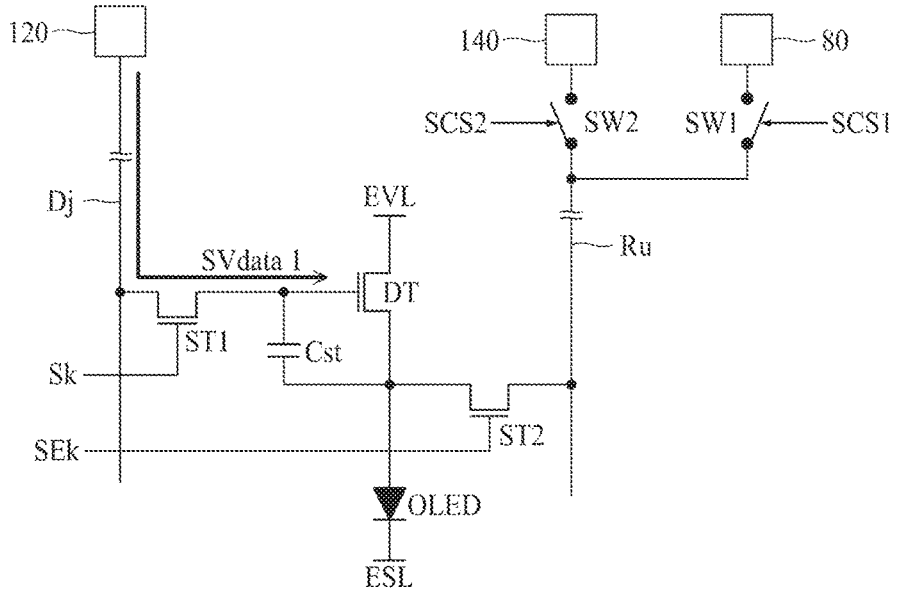
Figure 8C:
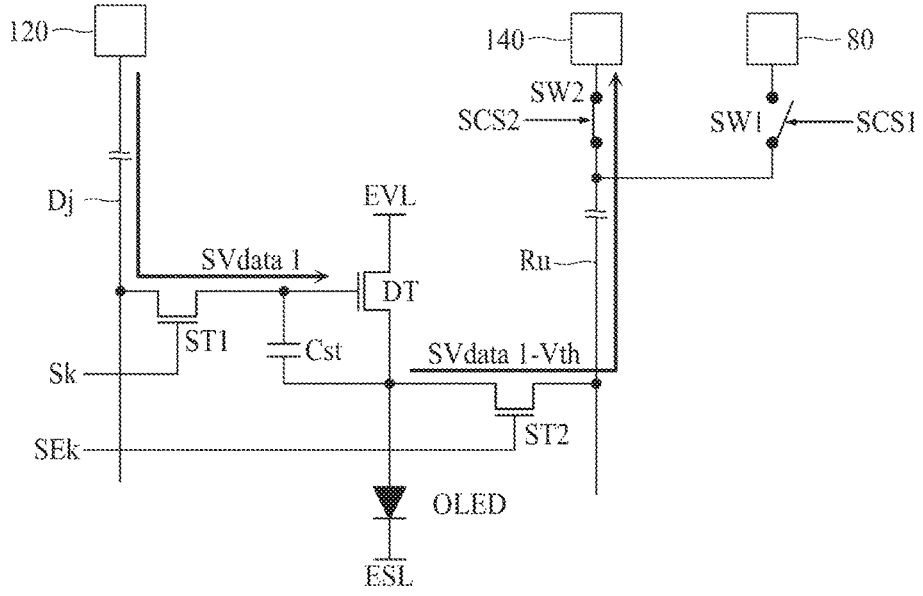

FIGS. 8A to 8C illustrate the operation of the pixel (P) for the first to third periods of the first sensing mode. Hereinafter, the operation of the pixel (P) in the first sensing mode will be described in detail with reference to FIG. 7 and FIGS. 8A to 8C.

Firstly, as shown in FIG. 8A, the first switching transistor (ST1) is turned-off by the kth scan signal (SCANk) of the gate-off voltage (Voff) supplied to the kth scan line (Sk) for the first period (t1'), and the second switching transistor (ST2) is turned-on by the kth sensing signal (SENSk) of the gate-on voltage (Von) supplied to the kth sensing signal line (SEk) for the first period (t1'). For the first period (t1'), the first switch (SW1) is turned-on by the first switch control signal (SCS1) of the first logic level voltage (V1), and the second switch (SW2) is turned-off by the second switch control signal (SCS2) of the second logic level voltage (V2).

For the first period (t1'), according as the first switch (SW1) is turned-on, the reference voltage (VREF) is supplied from the reference voltage generator 80 to the uth reference voltage line (Ru). For the first period (t1'), according as the second switching transistor (ST2) is turned-on, the reference voltage (VREF) of the uth reference voltage line (Ru) is supplied to the source electrode of the driving transistor (DT). That is, the source electrode of the driving transistor (DT) is initialized with the reference voltage (VREF).

Secondly, as shown in FIG. 8B, the first switching transistor (ST1) is turned-on by the kth scan signal (SCANk) of the gate-on voltage (Von) supplied to the kth scan line (Sk) for the second period (t2'), and the second switching transistor (ST2) is turned-on by the kth sensing signal (SENSk) of the gate-on voltage (Von) supplied to the kth sensing signal line (SEk) for the second period (t2'). For the second period (t2'), the first switch (SW1) is turned-off by the second switch control signal (SCS2) of the second logic level voltage (V2), and the second switch (SW2) is turned-off by the second switch control signal (SCS2) of the second logic level voltage (V2).

For the second period (t2'), according as the first switch (SW1) is turned-off, the reference voltage (VREF) is not supplied to the uth reference voltage line (Ru). For the second period (t2'), according as the first switching transistor (ST1) is turned-on, the first sensing data voltage (SVdata1) is supplied to the gate electrode of the driving transistor (DT).

For the second period (t2'), the differential voltage (Vgs=SVdata1−VREF) between the gate electrode and the source electrode of the driving transistor (DT) is larger than the threshold voltage (Vth) of the driving transistor (DT), whereby the current flows through the driving transistor (DT) until the differential voltage (Vgs) between the gate electrode and the source electrode of the driving transistor (DT) approaches the threshold voltage (Vth). Thus, the source voltage of the driving transistor (DT) is raised to "SVdata1−Vth". That is, the threshold voltage of the driving transistor (DT) is sensed in the source electrode of the driving transistor (DT) for the second period (t2').

Thirdly, as shown in FIG. 8C, the first switching transistor (ST1) is turned-on by the kth scan signal (SCANk) of the gate-on voltage (Von) supplied to the kth scan line (Sk) for the third period (t3'), and the second switching transistor (ST2) is turned-on by the kth sensing signal (SENSk) of the gate-on voltage (Von) supplied to the kth sensing signal line (SEk) for the third period (t3'). For the third period (t3'), the first switch (SW1) is turned-off by the second switch control signal (SCS2) of the second logic level voltage (V2), and the second switch (SW2) is turned-on by the second switch control signal (SCS2) of the first logic level voltage (V1).

For the third period (t3'), according as the second switch (SW2) is turned-on, the uth reference voltage line (Ru) is connected with the analog-to-digital converter 140. For the third period (t3'), according as the second switching transistor (ST2) is turned-on, the source electrode of the driving transistor (DT) is connected with the analog-to-digital converter 140 through the uth reference voltage line (Ru). Thus, it is possible to sense the source voltage of the driving transistor (DT), that is, "SVdata1−Vth" by the use of analog-to-digital converter 140.

As described above, it is possible to sense the source voltage of the driving transistor (DT), that is, "SVdata1−Vth", in which the threshold voltage of the driving transistor (DT) is reflected, for the first sensing mode according to one embodiment of the present disclosure.

Figure 9:
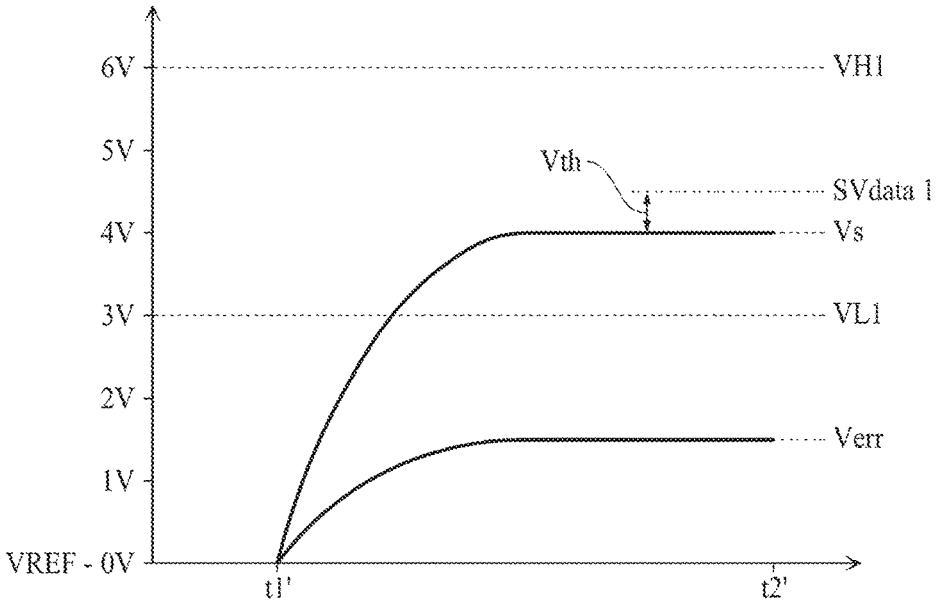
FIG. 9 is a graph illustrating one example showing a sensing voltage range of an analog-to-digital converter for the first sensing mode.

Meanwhile, for the first sensing mode, the current flows until the differential voltage (Vgs) between the gate electrode and the source electrode of the driving transistor (DT) approaches the threshold voltage (Vth) under the condition that the first sensing data voltage (SVdata1) is applied to the gate electrode of the driving transistor (DT) so that it is possible to sense the source voltage of the driving transistor (DT), which is raised to "SVdata1−Vth", as shown in FIG. 7. Accordingly, as shown in FIG. 9, the source voltage (Vs) of the driving transistor (DT), which is sensed for the first sensing mode, is raised almost to the voltage level of the first sensing data voltage (SVdata1). Thus, the sensing voltage range of the analog-to-digital converter 140 may be set between the first low voltage (VL1) which is higher than the reference voltage (VREF) and the first high voltage (VH1) for the first sensing mode. The analog-to-digital converter 140 may receive the first low voltage (VL1) and the first high voltage (VH1) from the reference voltage generator 80 so as to set the sensing voltage range of the first sensing mode. In FIG. 9, the first low voltage (VL1) is 3V, and the first high voltage (VH1) is 6V, but embodiments are not limited to these voltage values.

Meanwhile, as shown in FIG. 9, if the temperature of the display panel 10 is changed largely, the source voltage (Vs) of the driving transistor (DT) is raised out of the sensing voltage range of the analog-to-digital converter 140, which might cause an error voltage (Verr). If the temperature of the display panel 10 is too low, the source voltage (Vs) of the driving transistor (DT) may be raised only to the voltage level below the first low voltage (VL1). Meanwhile, if the temperature of the display panel 10 is too high, the source voltage (Vs) of the driving transistor (DT) may be raised to the voltage level above the first high voltage (VH1).

Figure 10:
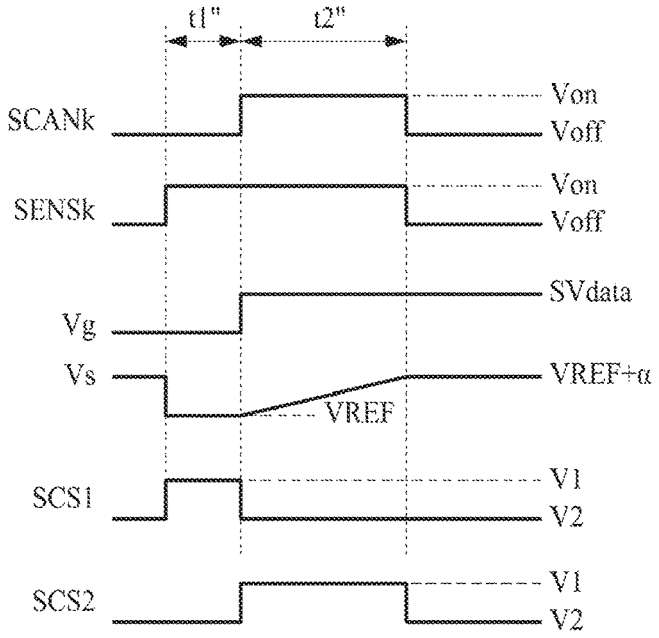
FIG. 10 is a waveform diagram illustrating scan and sensing signals supplied to the pixel, first and second switch control signals supplied to the first and second switches, and gate and source voltages of the driving transistor for a second sensing mode.

FIG. 10 is a waveform diagram illustrating the scan and sensing signals supplied to the pixel, the first and second switch control signals supplied to the first and second switches, and the gate and source voltages of the driving transistor for the second sensing mode.

For the second sensing mode, referring to FIG. 10, one frame period (1 frame period) may include first and second periods (t1", t2"). For the first period (t1"), the source electrode of the driving transistor (DT) is initialized with the reference voltage (VREF). For the second period (t2"), the second sensing data voltage (SVdata2) is supplied to the gate electrode of the driving transistor (DT), and the source voltage of the driving transistor (DT) is sensed.

The kth scan signal (SCANk) of the kth scan line (Sk) is supplied as a gate-on voltage (Von) for the second period (t2"). In FIG. 10, the kth scan signal (SCANk) of the kth scan line (Sk) is supplied as the gate-off voltage (Voff) for the first period (t1"). However, the kth scan signal (SCANk) of the kth scan line (Sk) may be supplied as the gate-on voltage (Von) for the first period (t1"). The kth sensing signal (SENSk) of the kth sensing signal line (SEk) is supplied as the gate-on voltage (Von) for the first and second periods (t1", t2"). The first and second switching transistors (ST1, ST2) of the pixel (P) may be turned-on by the gate-on voltage (Von), and may be turned-off by the gate-off voltage (Voff).

The first switch control signal (SCS1) may be supplied as a first logic level voltage (V1) for the first period (t1"), and may be supplied as a second logic level voltage (V2) for the second period (t2"). The second switch control signal (SCS2) may be supplied as the second logic level voltage (V2) for the first period (t1"), and may be supplied as the first logic level voltage (V1) for the second period (t2"). The first and second switches (SW1, SW2) may be turned-on by the first logic level voltage, and may be turned-off by the second logic level voltage.

Figure 11A:
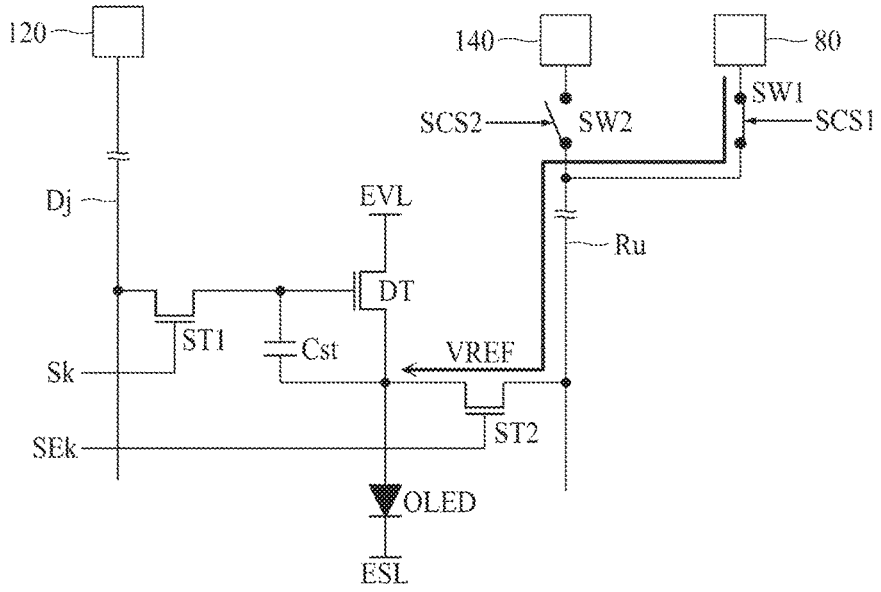
FIGS. 11A and 11B illustrate an operation of the pixel in the second sensing mode for first and second periods.
Figure 11B:
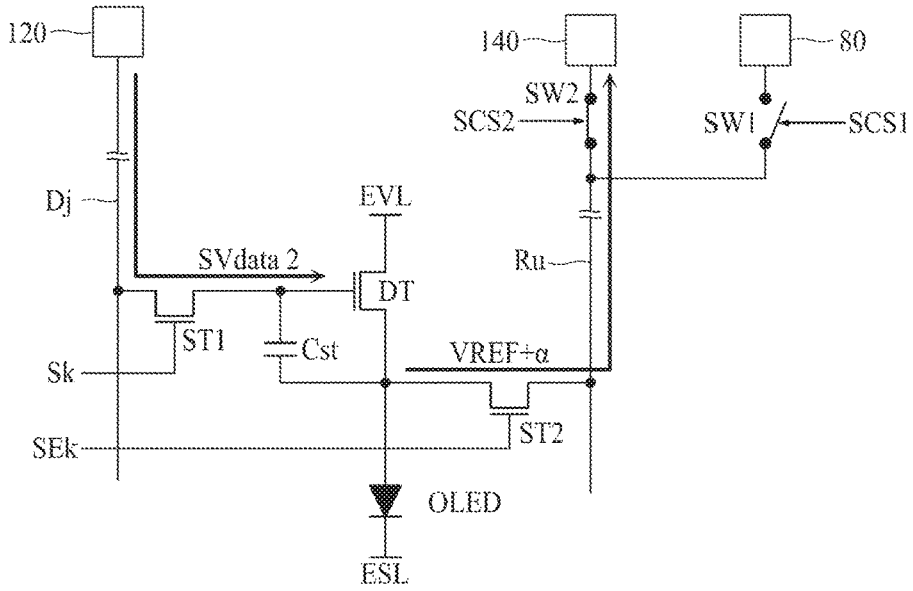

FIGS. 11A and 11B illustrate the operation of the pixel (P) for the first and second periods of the second sensing mode. Hereinafter, the operation of the pixel (P) in the second sensing mode will be described in detail with reference to FIG. 10 and FIGS. 11A and 11B.

Firstly, as shown in FIG. 11A, the first switching transistor (ST1) is turned-off by the kth scan signal (SCANk) of the gate-off voltage (Voff) supplied to the kth scan line (Sk) for the first period (t1"), and the second switching transistor (ST2) is turned-on by the kth sensing signal (SENSk) of the gate-on voltage (Von) supplied to the kth sensing signal line (SEk) for the first period (t1"). For the first period (t1"), the first switch (SW1) is turned-on by the first switch control signal (SCS1) of the first logic level voltage (V1), and the second switch (SW2) is turned-off by the second switch control signal (SCS2) of the second logic level voltage (V2).

For the first period (t1"), according as the first switch (SW1) is turned-on, the reference voltage (VREF) is supplied from the reference voltage generator 80 to the uth reference voltage line (Ru). For the first period (t1"), according as the second switching transistor (ST2) is turned-on, the reference voltage (VREF) of the uth reference voltage line (Ru) is supplied to the source electrode of the driving transistor (DT). That is, the source electrode of the driving transistor (DT) is initialized with the reference voltage (VREF).

Secondly, as shown in FIG. 11B, the first switching transistor (ST1) is turned-on by the kth scan signal (SCANk) of the gate-on voltage (Von) supplied to the kth scan line (Sk) for the second period (t2"), and the second switching transistor (ST2) is turned-on by the kth sensing signal (SENSk) of the gate-on voltage (Von) supplied to the kth sensing signal line (SEk) for the second period (t2"). For the second period (t2"), the first switch (SW1) is turned-off by the first switch control signal (SCS1) of the second logic level voltage (V2), and the second switch (SW2) is turned-on by the second switch control signal (SCS2) of the first logic level voltage (V1).

For the second period (t2"), according as the first switch (SW1) is turned-off, the reference voltage (VREF) is not supplied to the uth reference voltage line (Ru). For the second period (t2"), according as the second switch (SW2) is turned-on, the reference voltage line (Ru) is connected with the analog-to-digital converter 140. For the second period (t2"), according as the first switching transistor (ST1) is turned-on, the second sensing data voltage (SVdata2) is supplied to the gate electrode of the driving transistor (DT). For the second period (t2"), according as the second switching transistor (ST2) is turned-on, the source electrode of the driving transistor (DT) is connected with the analog-to-digital converter 140 through the uth reference voltage line (Ru).

For the second period (t2"), the differential voltage (Vgs=SVdata2−VREF) between the gate electrode and the source electrode of the driving transistor (DT) is larger than the threshold voltage (Vth) of the driving transistor (DT), whereby the current flows through the driving transistor (DT). The second period (t2") of FIG. 10 is shorter than the second period (t2') of FIG. 7.

In this case, the current of the driving transistor (DT) may be defined as the following Equation 1.

$$Ids = \frac{K \times Cox \times W / L}{2} \times (Vgs - Vth)^2 \quad \text{Equation 1}$$

In the above Equation 1, "Ids" is the current of the driving transistor (DT), "K" is the electron mobility, "Cox" is a capacitance of an insulating film, "W" is a channel width of the driving transistor (DT), and "L" is a channel length of the driving transistor (DT).

The current of the driving transistor (DT) is proportional to the electron mobility (K) of the driving transistor (DT), as shown in the above Equation 1, whereby a rise level of the source voltage (Vs) of the driving transistor (DT) for the second period (t2") is proportional to the electron mobility (K) of the driving transistor (DT). That is, the greater the electron mobility of the driving transistor (DT), the higher the rise level of the source voltage (Vs) of the driving transistor (DT) for the second period (t2").

Eventually, the rise level of the source voltage (Vs) of the driving transistor (DT) is changed in accordance with the electron mobility (K) of the driving transistor (DT) for the second period (t2"). In FIG. 9, the rise level of the source voltage (Vs) in accordance with the electron mobility (K) is defined as "α". The source voltage of the driving transistor (DT) is raised to "VREF+α", as shown in FIG. 9, in accordance with the electron mobility (K). Thus, it is possible to sense the voltage, on which the electron mobility (K) of the driving transistor (DT) is reflected, in the source electrode of the driving transistor (DT) for the second period (t2").

As described above, it is possible to sense the source voltage of the driving transistor, that is, "VREF+α", on which the electron mobility (K) of the driving transistor (DT) is reflected, for the second sensing mode according to one embodiment of the present disclosure.

Figure 12:
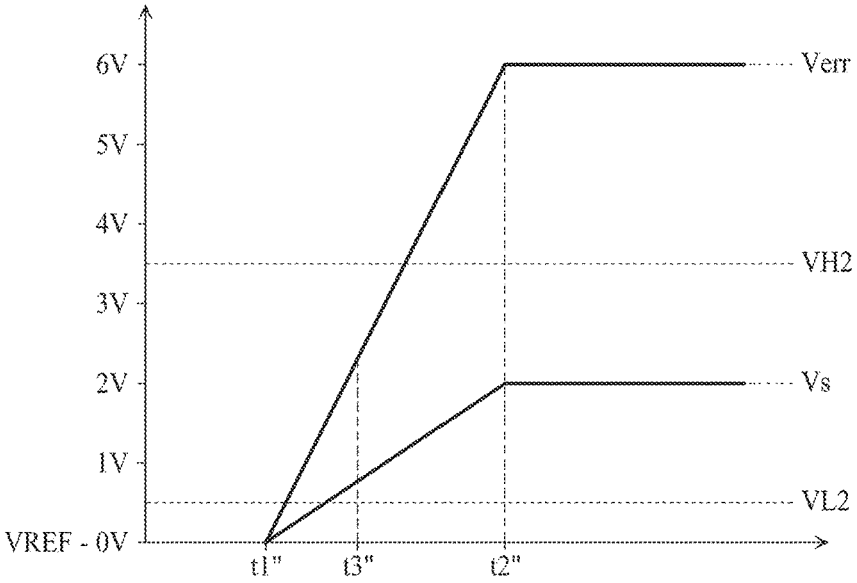
FIG. 12 is a graph illustrating one example showing a sensing voltage range of an analog-to-digital converter for the second sensing mode.

Meanwhile, for the second sensing mode, the rise level of the source voltage (Vs) in the driving transistor (DT) is sensed for the predetermined short period (e.g., during the second period t2") under the condition that the second sensing data voltage (SVdata2) is applied to the gate electrode of the driving transistor (DT). Accordingly, as shown in FIG. 12, the source voltage (Vs) of the driving transistor (DT) sensed for the second sensing mode is higher than the reference voltage (VREF). However, the rise level of the source voltage (Vs) in the driving transistor (DT) for the second sensing mode is relatively smaller than the rise level of the source voltage (Vs) in the driving transistor (DT) for the first sensing mode. Thus, for the second sensing mode, the sensing voltage range of the analog-to-digital converter 140 may be set within a range between a second low voltage (VL2), which is higher than the reference voltage (VREF) and is lower than the first low voltage (VL1), and a second high voltage (VH2) which is lower than the first high voltage (VH1). The analog-to-digital converter 140 may receive the second low voltage (VL2) and the second high voltage (VH2) from the reference voltage generator 80 so as to set the sensing voltage range for the second sensing mode. In FIG. 12, the second low voltage (VL2) is 0.5V, and the second high voltage (VH2) is 3.5V, but embodiments are not limited to these voltage values.

In this case, the rise level of the source voltage (Vs) of the driving transistor (DT) is changed in accordance with the temperature of the display panel 10. Especially, if the temperature of the display panel 10 is higher than a rating temperature at which the display panel 10 is normally driven, the source voltage (Vs) of the driving transistor (DT) is raised highly so that the source voltage (Vs) of the driving transistor (DT) is out of the sensing voltage range of the analog-to-digital converter 140, which might cause an error voltage.

If the temperature of the display panel 10 becomes high, the sensing timing is set to be earlier than the second period (t2") so as to prevent the source voltage (Vs) of the driving transistor (DT) from being out of the sensing voltage range of the analog-to-digital converter 140. That is, the sensing timing may be set so that the rise of the source voltage (Vs) is sensed before the end of the second period (t2"). As described above, the sensing timing may be controlled by changing the setting inside the timing controller 60, and the timing controller 60 may change the sensing timing based on a monitored temperature of the display panel 10. The sensing timing may be set to be earlier than the end of the second period (t2") and after the first period (t1"). For example, the sensing timing may be set such that the source voltage (Vs) is sensed at a third time (t3"), which occurs after the first period (t1") and before the end of the second period (t2"), as shown in FIG. 12.

In case of a temperature rise in an OLED device according to another embodiment of the present disclosure, the source voltage (Vs) of the driving transistor (DT) is lowered so that it is possible to prevent the source voltage (Vs) of the driving transistor (DT) from being out of the sensing voltage range of the analog-to-digital converter 140. The source voltage (Vs) of the driving transistor (DT) may be lowered by lowering a gate voltage (Vg) of the driving transistor (DT), e.g., by reducing the second sensing data voltage (SVdata2) that is applied to the gate of the driving transistor (DT) during the second period (t2"). According as the gate voltage (Vg) of the driving transistor (DT) is lowered, the source voltage (Vs) of the driving transistor (DT) is also lowered. Thus, even in case of the temperature rise, the source voltage (Vs) of the driving transistor (DT) is within the sensing voltage range of the analog-to-digital converter 140.

Figure 13:
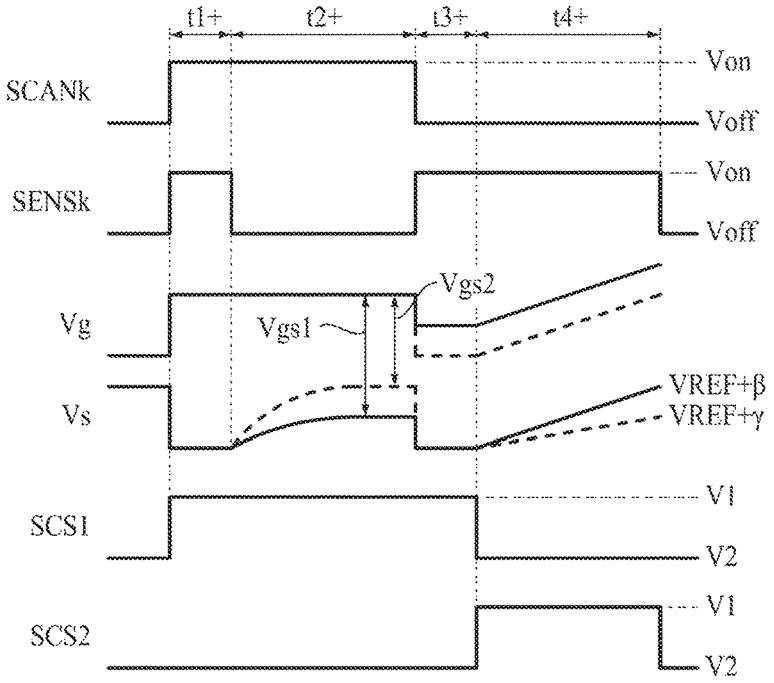
FIG. 13 is a waveform diagram illustrating scan and sensing signals supplied to the pixel, first and second switch control signals supplied to the first and second switches, and gate and source voltages of the driving transistor for a third sensing mode.

FIG. 13 is a waveform diagram illustrating the scan and sensing signals supplied to the pixel, the switch control signal supplied to the switch, and the gate and source voltages of the driving transistor for the third sensing mode.

For the third sensing mode, referring to FIG. 13, one frame period (1 frame period) may include first to fourth periods (t1+, t2+, t3+, t4+). For the first period (t1+), the third sensing data voltage (SVdata3) is supplied to the gate electrode of the driving transistor (DT), and the source electrode of the driving transistor (DT) is initialized with the reference voltage (VREF). For the second period (t2+), the gate-to-source voltage of the driving transistor (DT) is stored in the storage capacitor (Cst) in accordance with a deterioration level of the organic light emitting diode (OLED), which corresponds to a deterioration recognition period. For the third period (t3+), the source electrode of the driving transistor (DT) is initialized with the reference voltage (VREF). For the fourth period (t4+), it is possible to sense the source voltage (Vs) of the driving transistor (DT) in accordance with the gate-to-source voltage of the driving transistor (DT).

The kth scan signal (SCANk) of the kth scan line (Sk) is supplied as the gate-on voltage (Von) for the second period (t2+), and is supplied as the gate-off voltage (Voff) for the third and fourth periods (t3+, t4+). In FIG. 13, the kth scan signal (SCANk) of the kth scan line (Sk) is supplied as the gate-on voltage (Von) for the first period (t1+). However, the kth scan signal (SCANk) of the kth scan line (Sk) may be supplied as the gate-off voltage (Voff) for the first period (t1+). The kth sensing signal (SENSk) of the kth sensing signal line (SEk) is supplied as the gate-on voltage (Von) for the first, third, and fourth periods (t1+, t3+, t4+), and is supplied as the gate-off voltage (Voff) for the second period (t2+). The first and second switching transistors (ST1, ST2) of the pixel (P) may be turned-on by the gate-on voltage (Von), and may be turned-off by the gate-off voltage (Voff).

The first switch control signal (SCS1) may be supplied as a first logic level voltage (V1) for the first and third period (t1+, t3+), and may be supplied as a second logic level voltage (V2) for the fourth period (t4+). In FIG. 13, the first switch control signal (SCS1) is supplied as the first logic level voltage (V1) for the second period (t2+), but not necessarily. The first switch control signal (SCS1) may be supplied as the second logic level voltage (V2) for the second period (t2+). The second switch control signal (SCS2) may be supplied as the second logic level voltage (V2) for the first to third periods (t1+, t2+, t3+), and may be supplied as the first logic level voltage (V1) for the fourth period (t4+). The first and second switches (SW1, SW2) may be turned-on by the first logic level voltage, and may be turned-off by the second logic level voltage.

Figure 14A:
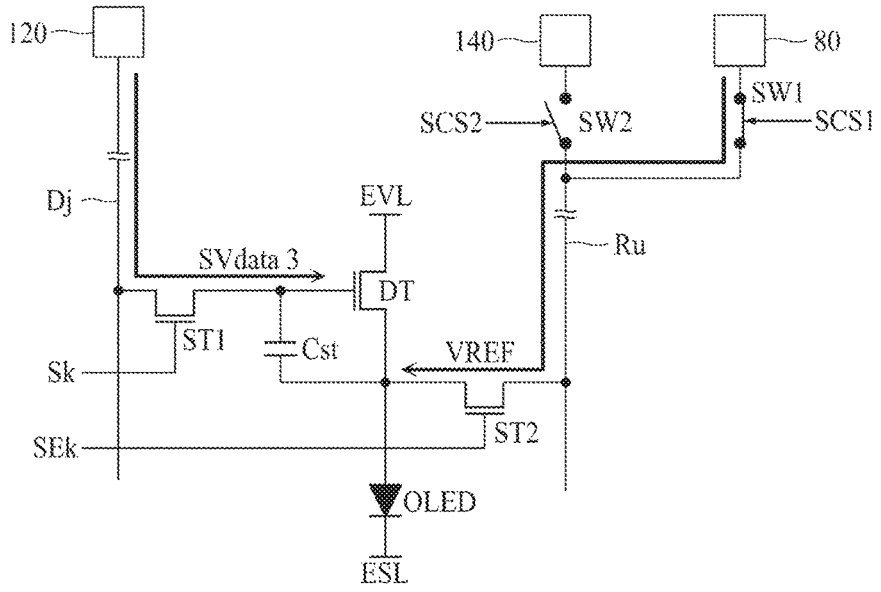
FIGS. 14A to 14D illustrate an operation of the pixel in the third sensing mode for first to fourth periods.
Figure 14B:
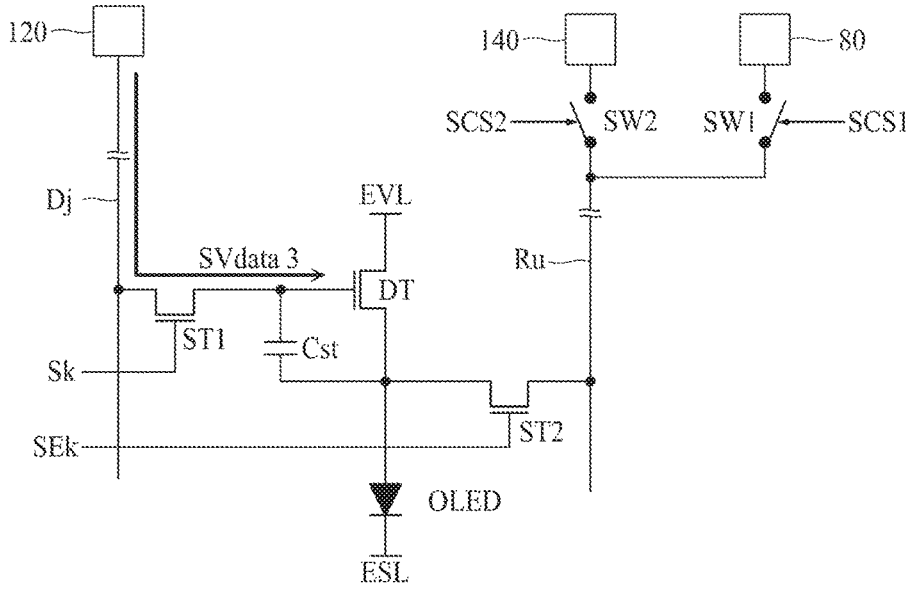
Figure 14C:
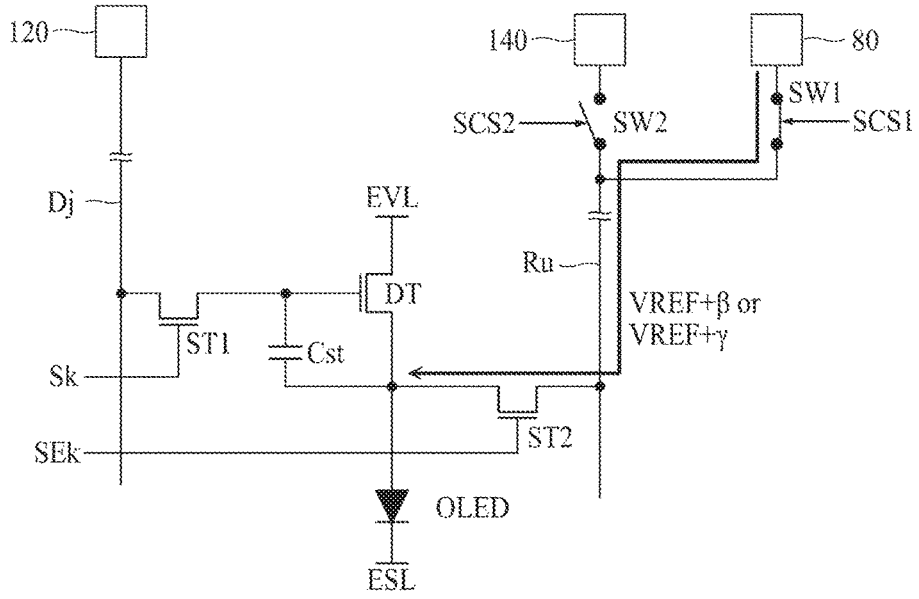

FIGS. 14A to 14C illustrate the operation of the pixel (P) for the first to fourth periods of the third sensing mode.

Firstly, as shown in FIG. 14A, the first switching transistor (ST1) is turned-on by the kth scan signal (SCANk) of the gate-on voltage (Von) supplied to the kth scan line (Sk) for the first period (t1+), and the second switching transistor (ST2) is turned-on by the kth sensing signal (SENSk) of the gate-on voltage (Von) supplied to the kth sensing signal line (SEk) for the first period (t1+). For the first period (t1+), the first switch (SW1) is turned-on by the first switch control signal (SCS1) of the first logic level voltage (V1), and the second switch (SW2) is turned-off by the second switch control signal (SCS2) of the second logic level voltage (V2).

For the first period (t1+), according as the first switching transistor (ST1) is turned-on, the third sensing data voltage (SVdata3) is supplied to the gate electrode of the driving transistor (DT). Also, for the first period (t1+), according as the switch (SW1) is turned-on, the reference voltage (VREF) is supplied from the reference voltage generator 80 to the uth reference voltage line (Ru). For the first period (t1+), according as the second switching transistor (ST2) is turned-on, the reference voltage (VREF) of the uth reference voltage line (Ru) is supplied to the source electrode of the driving transistor (DT). That is, the source electrode of the driving transistor (DT) is initialized with the reference voltage (VREF).

Secondly, as shown in FIG. 14B, the first switching transistor (ST1) is turned-on by the kth scan signal (SCANk) of the gate-on voltage (Von) supplied to the kth scan line (Sk) for the second period (t2+), and the second switching transistor (ST2) is turned-off by the kth sensing signal (SENSk) of the gate-off voltage (Voff) supplied to the kth sensing signal line (SEk) for the second period (t2+).

For the second period (t2+), the first switching transistor (ST1) is turned-on, whereby the third sensing data voltage (SVdata3) is supplied to the gate electrode of the driving transistor (DT). Also, for the second period (t2+), according as the second switch (SW2) is turned-off, the reference voltage (VREF) is not supplied to the source electrode of the driving transistor (DT).

For the second period (t2+), the differential voltage (Vgs=SVdata3−VREF) between the gate electrode and the source electrode of the driving transistor (DT) is larger than the threshold voltage (Vth) of the driving transistor (DT), whereby the current flows through the driving transistor (DT).

Meanwhile, if the organic light emitting diode (OLED) is driven for a long time, the organic light emitting diode (OLED) may be deteriorated, whereby a light-emission luminance of the organic light emitting diode (OLED) may be deteriorated. If the organic light emitting diode (OLED) is deteriorated, the driving voltage of the organic light emitting diode (OLED) is raised. Thus, as shown in FIG. 13, even though the same data voltage is applied to the gate electrode of the driving transistor (DT), the source voltage of the driving transistor (DT) when the organic light emitting diode (OLED) is deteriorated is higher than the source voltage of the driving transistor (DT) when the organic light emitting diode (OLED) is not deteriorated. Accordingly, the gate-to-source voltage (Vgs2) of the driving transistor (DT) when the organic light emitting diode (OLED) is deteriorated is lower than the gate-to-source voltage (Vgs1) of the driving transistor (DT) when the organic light emitting diode (OLED) is not deteriorated. In FIG. 13, a solid line indicates the gate voltage (Vg) and the source voltage (Vs) of the driving transistor (DT) when the organic light emitting diode (OLED) is not deteriorated, and a dotted line indicates the gate voltage (Vg) and the source voltage (Vs) of the driving transistor (DT) when the organic light emitting diode (OLED) is deteriorated.

In this case, the gate voltage (Vg) and the source voltage (Vs) of the driving transistor (DT) may be changed by the temperature of the display panel 10. In more detail, if the temperature of the display panel 10 rises, the gate voltage (Vg) and the source voltage (Vs) of the driving transistor (DT) also rise. In order to mitigate this phenomenon, the OLED device according to one embodiment of the present disclosure lowers the gate voltage (Vg) and the source voltage (Vs) if the temperature of the display panel 10 rises.

By lowering the gate voltage (Vg) and the source voltage (Vs), even though the temperature of the display panel 10 may be the same as or higher than a critical temperature, the source voltage (Vs) of the driving transistor (DT) is not out of the voltage sensing range of the analog-to-digital converter 140.

Thirdly, as shown in FIG. 14C, the first switching transistor (ST1) is turned-off by the kth scan signal (SCANk) of the gate-off voltage (Voff) supplied to the kth scan line (Sk) for the third period (t3+), and the second switching transistor (ST2) is turned-on by the kth sensing signal (SENSk) of the gate-on voltage (Von) supplied to the kth sensing signal line (SEk) for the third period (t3+). For the third period (t3+), the first switch (SW1) is turned-on by the first switch control signal (SCS1) of the first logic level voltage (V1), and the second switch (SW2) is turned-off by the second switch control signal (SCS2) of the second logic level voltage (V2).

For the third period (t3+), according as the first switch (SW1) is turned-on, the reference voltage (VREF) is supplied from the reference voltage generator 80 to the uth reference voltage line (Ru). For the third period (t3+), according as the second switching transistor (ST2) is turned-on, the reference voltage (VREF) of the uth reference voltage line (Ru) is supplied to the source electrode of the driving transistor (DT). That is, the source electrode of the driving transistor (DT) is initialized with the reference voltage (VREF). Also, the gate-to-source voltage (Vgs) of the driving transistor (DT) is maintained by the storage capacitor (Cst), whereby the gate voltage (Vg) of the driving transistor (DT) may be lowered by the change amount of the source voltage (Vs) of the driving transistor (DT), as shown in FIG. 13.

Figure 14D:
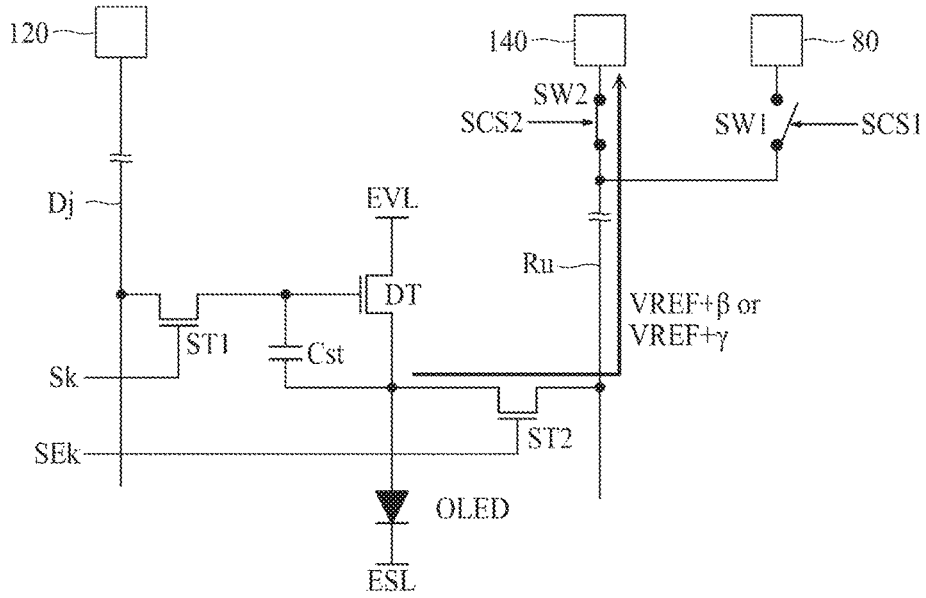

Fourthly, as shown in FIG. 14D, the first switching transistor (ST1) is turned-off by the kth scan signal (SCANk)

of the gate-off voltage (Voff) supplied to the kth scan line (Sk) for the fourth period (t4+), and the second switching transistor (ST2) is turned-on by the kth sensing signal (SENSk) of the gate-on voltage (Von) supplied to the kth sensing signal line (SEk) for the fourth period (t4+). For the fourth period (t4+), the first switch (SW1) is turned-off by the first switch control signal (SCS1) of the second logic level voltage (V2), and the second switch (SW2) is turned-on by the second switch control signal (SCS2) of the first logic level voltage (V1).

For the fourth period (t4+), the current flows through the driving transistor (DT) in accordance with the gate-to-source voltage (Vgs), whereby the source voltage of the driving transistor (DT) rises. However, if the organic light emitting diode (OLED) is deteriorated, the gate-to-source voltage (Vgs2) of the driving transistor (DT) when the organic light emitting diode (OLED) is deteriorated is lower than the gate-to-source voltage (Vgs1) of the driving transistor (DT) when the organic light emitting diode (OLED) is not deteriorated. Thus, for the fourth period (t4+), the rise level of the source voltage (Vs) of the driving transistor (DT) when the organic light emitting diode (OLED) is deteriorated is relatively small compared to the rise level of the source voltage (Vs) of the driving transistor (DT) when the organic light emitting diode (OLED) is not deteriorated. For example, as shown in FIG. 13, when the organic light emitting diode (OLED) is not deteriorated, the source voltage (Vs) of the driving transistor (DT) is raised to "VREF+β" for the fourth period (t4+). Meanwhile, when the organic light emitting diode (OLED) is deteriorated, the source voltage (Vs) of the driving transistor (DT) may be raised to "VREF+γ(β>γ)" for the fourth period (t4+).

For the fourth period (t4+), according as the second switch (SW2) is turned-on, the uth reference voltage line (Ru) is connected with the analog-to-digital converter 140. For the fourth period (t4+), the second switching transistor (ST2) is turned-on so that the source electrode of the driving transistor (DT) is connected with the analog-to-digital converter 140 through the uth reference voltage line (Ru). Accordingly, the analog-to-digital converter 140 may sense the source voltage (Vs) of the driving transistor (DT), that is, "VREF+β" or "VREF+γ".

Figure 15:
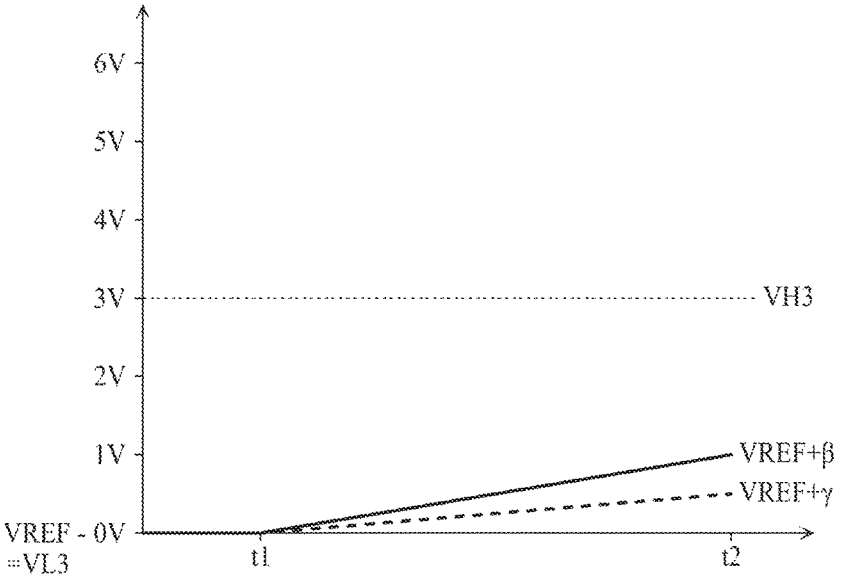
FIG. 15 is a graph illustrating one example showing a sensing voltage range of an analog-to-digital converter for the third sensing mode.
Figure 16:
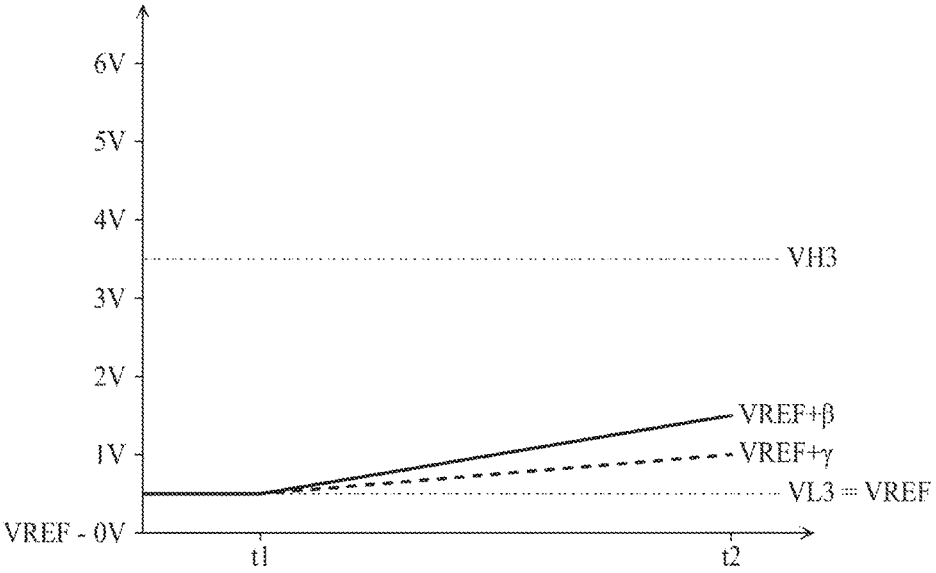
FIG. 16 is a graph illustrating another example showing a sensing voltage range of an analog-to-digital converter for the third sensing mode.

FIGS. 15 and 16 are graphs illustrating examples of sensing voltage ranges of an analog-to-digital converter that may be used in the third sensing mode. For example, as shown in FIG. 15, the sensing voltage range of the analog-to-digital converter 140 may be set within a range between a third low voltage (VL3), which may be equal to the reference voltage (VREF) and may be 0V, and a third high voltage (VH3), which may be, for example 3V higher than the reference voltage (VREF). As shown in FIG. 16, the sensing voltage range of the analog-to-digital converter 140 may be set such that the third low voltage (VL3) is equal to the reference voltage (VREF) and set at about 0.5V, and a third high voltage (VH3) may be about 3V higher than the reference voltage (VREF), and set at about 3.5V.

Figure 17:
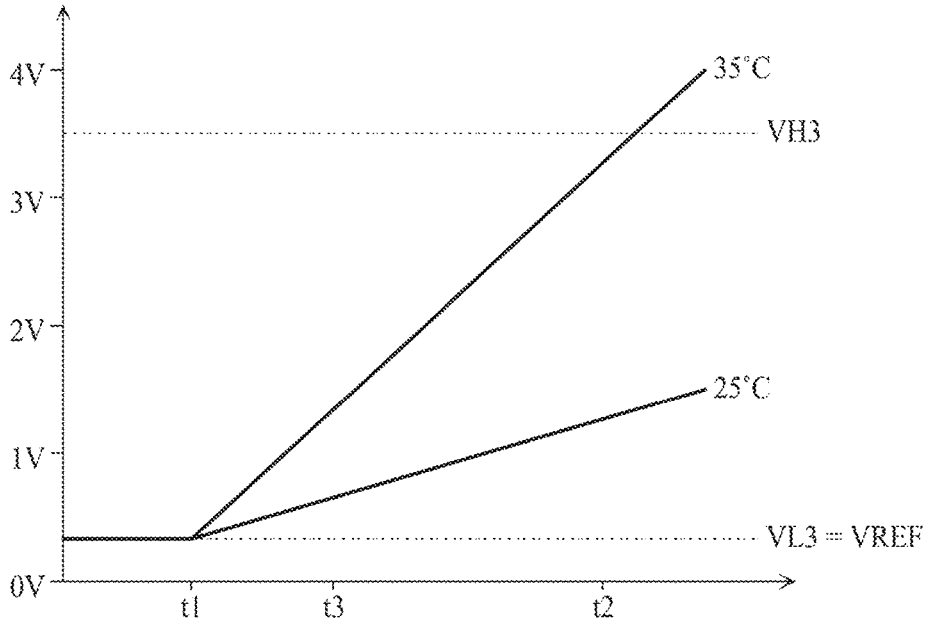
FIG. 17 is a graph illustrating another example showing a sensing voltage range of an analog-to-digital converter in accordance with a temperature for the third sensing mode.

FIG. 17 is a graph illustrating another example of the sensing voltage range of the analog-to-digital converter in accordance with the temperature for the first to third sensing modes.

After the supply of sensing voltage is started at a first time point (t1), the analog-to-digital converter 140 according to one embodiment of the present disclosure starts to extract sensing voltage information. In case of a normal driving, the analog-to-digital converter 140 according to one embodiment of the present disclosure sets a second time point (t2) as the sensing timing, and executes the sensing process with reference to a voltage level of the second time point (t2). For the process of executing the sensing mode, it is important to prevent the sensing voltage from being out of the sensing voltage range of the analog-to-digital converter 140 at a high temperature. For example, the sensing voltage range of the analog-to-digital converter 140 may be set with a range of 0.5V~3.5V, and a normal temperature of the display panel 10 may be about 25° C. In this case, a final sensing voltage is 3.5V or less than 3.5V. Thus, even though the sensing timing is set to the second time point (t2), it is possible to execute the normal sensing process.

However, in case of display panel 10 at a temperature of 35° C., a final sensing voltage is higher than 3.5V, and a sensing voltage of the second time point (t2) is 3.5V. If the temperature of the display panel 10 is high, the sensing voltage is raised rapidly. In case of the display panel 10 at the high temperature state above 35° C., the sensing voltage at the second time point (t2) is 3.5V. Thus, in case of the display panel 10 at the high temperature state above 35° C., if the sensing timing is set to the second time point (t2), it is difficult to execute the normal sensing process.

In the display panel 10 according to one embodiment of the present disclosure, the sensing timing point is set to a third time point (t3) between the first time point (t1) and the second time point (t2). According to one embodiment of the present disclosure, the sensing timing is advanced, and the sensing process is executed with reference to a sensing voltage level of the third time point (t3). The third time point (t3) may be set in accordance with the temperature of the display panel 10 under the control of the timing controller 60. The sensing voltage level of the third time point (t3) is set within the sensing voltage range of the analog-to-digital converter 140. Accordingly, it is possible to sense a value within the sensing voltage range of the analog-to-digital converter 140.

According to one embodiment of the present disclosure, the sensing timing is controlled in such a way that the source voltage of the driving transistor sensed for the sensing mode is included within the sensing voltage range. Accordingly, it is possible to prevent the source voltage of the driving transistor from being out of the sensing voltage range of the analog-to-digital converter 140.

In the OLED device according to one embodiment of the present disclosure, initial data corresponding to the sensing data before the deterioration is stored by each temperature range of the organic light emitting diode. Herein, the initial data may be defined as reference data, and the initial data may be measured before the deterioration of the organic light emitting diode, and stored in the internal memory. In the OLED device according to one embodiment of the present disclosure, the sensing condition and the initial data of the corresponding temperature range may be retrieved from the internal memory, to thereby execute the sensing work in accordance with the sensing condition of the retrieved temperature range. Eventually, the sensing timing is controlled in such a way that the source voltage of the driving transistor sensed based on the sensing condition is included in the sensing voltage range, or the sensing timing is controlled by lowering the voltage supplied to the driving transistor.

In the OLED device according to one embodiment of the present disclosure, even though the properties of the organic light emitting diode may be changed based on the temperature, it is possible to prevent an influence on the sensing data. Especially, even if the sensing work is executed even in the other temperature range, it is possible to apply the sensing data appropriate for the corresponding temperature range so that it does not exceed the ADC range.

It will be apparent to those skilled in the art that various modifications and variations can be made in the present disclosure without departing from the spirit or scope of the disclosures. Thus, it is intended that the present disclosure covers the modifications and variations of this disclosure provided they come within the scope of the appended claims and their equivalents.

The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. An organic light emitting display (OLED) device, comprising:

a display panel having a plurality of pixels, each of the pixels including an organic light emitting diode, wherein the pixels are connected with data lines, scan lines, and reference voltage lines;

an analog-to-digital converter that senses voltages of the pixels through the reference voltage lines, and outputs sensing data as digital data; and a reference voltage generator that supplies a reference voltage to the reference voltage lines in a display mode during which the pixels emit light, wherein the analog-to-digital converter advances a sensing timing during which the analog-to-digital converter senses the voltages of the pixels based on a temperature of the display panel, wherein the sensing timing is advanced to a point in time that precedes a normal sensing timing of the analog-to-digital converter.

2. The OLED device according to claim 1, wherein the sensing timing is advanced if a sensed voltage of the normal sensing timing exceeds a sensing voltage range of the analog-to-digital converter.

3. The OLED device according to claim 2, wherein the sensing timing is advanced to a point in time that occurs before the sensed voltage exceeds the sensing voltage range of the analog-to-digital converter.

4. The OLED device according to claim 1, further comprising a timing controller that measures a temperature of the display panel, and supplies measured temperature information to the analog-to-digital converter.

5. The OLED device according to claim 1, further comprising a memory that stores data indicative of the sensing voltage range of the analog-to-digital converter.

6. The OLED device of claim 5, wherein the memory further stores temperature data associated with the data indicative of the sensing voltage range.

7. The OLED device according to claim 1, wherein the analog-to-digital converter senses the voltages of the pixels in any one among a threshold voltage compensating mode, an electron mobility compensating mode, and a deterioration compensating mode.

8. The OLED device according to claim 7, wherein the analog-to-digital converter advances the sensing timing based on the temperature of the display panel in each of the threshold voltage compensating mode, the electron mobility compensating mode, and the deterioration compensating mode.

9. The OLED device according to claim 1, wherein a level of a gate voltage of the driving transistor is lowered in response to a sensed voltage of the normal sensing timing exceeding a sensing voltage range of the analog-to-digital converter.

10. A method for driving an OLED device including a display panel having a plurality of pixels, each of the pixels including an organic light emitting diode, wherein the pixels are connected with data lines, scan lines, and reference voltage lines, the method comprising:

supplying a reference voltage to the reference voltage lines in a display mode during which each pixel emits light;

sensing voltages of the pixels through the reference voltage lines within a sensing voltage range of an analog-to-digital converter, and outputting sensing data as digital data; and advancing a sensing timing during which the voltages of the pixels are sensed based on a temperature of the display panel, wherein the sensing timing is advanced to a point in time that precedes a normal sensing timing of the OLED.

11. The method according to claim 10, wherein the sensing timing is advanced if a sensed voltage of the normal sensing timing exceeds the sensing voltage range of the analog-to-digital converter.

12. The method according to claim 11, wherein the sensing timing is advanced to a point in time that occurs before the sensed voltage exceeds the sensing voltage range of the analog-to-digital converter.

13. The method according to claim 10, further comprising:

measuring the temperature of the display panel; and changing the sensing timing based on the measured temperature.

14. The method according to claim 10, wherein the sensing is performed in any one among a threshold voltage compensating mode, an electron mobility compensating mode, and a deterioration compensating mode.

15. The method according to claim 14, wherein the sensing timing is advanced based on the temperature of the display panel in each of the threshold voltage compensating mode, the electron mobility compensating mode, and the deterioration compensating mode.

16. The method according to claim 10, further comprising:

decreasing a level of a gate voltage of the driving transistor in response to a sensed voltage of the normal sensing timing exceeding the sensing voltage range of the analog-to-digital converter.

17. The method according to claim 10, further comprising:

storing data indicative of the sensing voltage range of the analog-to-digital converter in a memory.

18. The method according to claim 17, further comprising:

storing temperature data in the memory, the temperature data being associated with the data indicative of the sensing voltage.

* * * * *